US009811018B2

(12) United States Patent
Taguchi et al.

(10) Patent No.: US 9,811,018 B2
(45) Date of Patent: Nov. 7, 2017

(54) NEGATIVELY-CHARGEABLE TONER AND METHOD FOR MANUFACTURING SAME

(71) Applicant: ZEON CORPORATION, Tokyo (JP)

(72) Inventors: Hiroyuki Taguchi, Tokyo (JP); Hisashi Kurokawa, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 15/038,212

(22) PCT Filed: Nov. 28, 2014

(86) PCT No.: PCT/JP2014/081644

§ 371 (c)(1),
(2) Date: May 20, 2016

(87) PCT Pub. No.: WO2015/080272

PCT Pub. Date: Jun. 4, 2015

(65) Prior Publication Data

US 2016/0291495 A1 Oct. 6, 2016

(30) Foreign Application Priority Data

Nov. 28, 2013 (JP) ..... 2013-246422
Dec. 25, 2013 (JP) ..... 2013-267064

(51) Int. Cl.

| | |
|---|---|
| ***G03G 9/135*** | (2006.01) |
| ***G03G 9/097*** | (2006.01) |
| ***G03G 9/08*** | (2006.01) |
| ***G03G 9/087*** | (2006.01) |
| ***G03G 9/09*** | (2006.01) |

(52) U.S. Cl.
CPC ..... *G03G 9/09775* (2013.01); *G03G 9/0806* (2013.01); *G03G 9/08755* (2013.01); *G03G 9/0904* (2013.01)

(58) Field of Classification Search
CPC ..... G03G 9/09775; G03G 9/0806; G03G 9/0904; G03G 9/08755; G03G 9/097; G03G 9/093
See application file for complete search history.

(56) References Cited

U.S. PATENT DOCUMENTS

| | | | | |
|---|---|---|---|---|
| 6,342,328 | B1 | 1/2002 | Takasaki et al. | |
| 2004/0106056 | A1* | 6/2004 | Takezawa | G03G 9/08755 430/108.4 |
| 2006/0177754 | A1* | 8/2006 | Miyakawa | G03G 9/0804 430/108.6 |
| 2008/0089722 | A1* | 4/2008 | Ojima | G03G 9/08711 399/270 |
| 2010/0261108 | A1* | 10/2010 | Yamanouchi | G03G 9/08711 430/97 |
| 2013/0171552 | A1 | 7/2013 | Yoshizaki et al. | |

FOREIGN PATENT DOCUMENTS

| | | | |
|---|---|---|---|
| JP | 11-184165 | A | 7/1999 |
| JP | 11-288129 | A | 10/1999 |
| JP | 11-327208 | A | 11/1999 |
| JP | 2003-43752 | A | 2/2003 |
| JP | 2006-78982 | A | 3/2006 |
| JP | 2006-276293 | A | 10/2006 |
| JP | 2007-133113 | A | 5/2007 |
| JP | 2009-168963 | A | 7/2009 |
| JP | 2012-78809 | A | 4/2012 |
| JP | 2013-214005 | A | 10/2013 |

OTHER PUBLICATIONS

Search Report dated Feb. 17, 2015, issued in counterpart International Application No. PCT/JP2014/081644 (2 pages).
Translation of Notification of Transmittal of Translation of the International Preliminary Report on Patentability (Form PCT/IB/338) dated Jun. 9, 2016, issued in International Application No. PCT/JP2014/081644, with Form PCT/IB/373 and Form PCT/ISA/237. (7 pages).

* cited by examiner

*Primary Examiner* — Thorl Chea
(74) *Attorney, Agent, or Firm* — Westerman, Hattori, Daniels & Adrian, LLP

(57) ABSTRACT

Provided are a method for producing a negatively-chargeable toner that has a narrow particle diameter distribution even when produced by a polymerization method, and a negatively-chargeable toner that is excellent in balance between low-temperature fixability and heat-resistant shelf stability, has fine thin-line reproducibility, and generates little fog, even in high-speed printing. The negatively-chargeable toner includes colored resin particles which contain at least a binder resin, a colorant, a charge control agent and a softening agent, wherein the charge control agent is a copolymer which is obtained by copolymerizing a vinyl aromatic hydrocarbon, a (meth)acrylate and a sulfonic acid group-containing (meth)acrylamide and in which a copolymerization ratio of the sulfonic acid group-containing (meth)acrylamide is 0.8 to 4.0% by mass, and wherein the softening agent is at least one of a monoester compound and a polyglycerol ester compound.

10 Claims, No Drawings

NEGATIVELY-CHARGEABLE TONER AND METHOD FOR MANUFACTURING SAME

TECHNICAL FIELD

The present invention relates to a negatively-chargeable toner that can be used for the development of image forming devices utilizing an electrophotographic method such as copying machines, facsimile machines and printers, and a method for producing the negatively-chargeable toner.

BACKGROUND ART

In recent years, needs for colorization has been increasing in image forming devices using an electrophotographic method such as combined machines, facsimile machines and printers. In color printing, printing of an image for which reproduction of a color tone that has a high definition and is sharp like a photograph is also carried out, and thus a color toner that can correspond to the image is required. Furthermore, for such toner, there are needed various printing performances such as environmental stability in view of prevention of deterioration of an image quality due to environmental changes such as temperature and humidity, printing durability in view of decreasing of printing costs, and a low-temperature fixability in view of decreasing of power consumption.

In order to respond to the above-mentioned requirements, a spherical toner having a small particle diameter is suitable since the toner can attain both fine transfer property and dot reproducibility, and as a method for producing the toner, a polymerization method is suggested. In a conventional pulverizing process, specifically in the case when a toner having a small particle diameter is produced, the yield is low, and much energy is consumed in pulverization, whereas in a polymerization method, the yield is high, the consumed energy is low since the method does not require a pulverizing step, and a spherical toner can be easily produced.

As method for producing a toner by a polymerization method (hereinafter referred to as "polymerized toner"), a suspension polymerization method, an emulsification polymerization method and a dispersion polymerization method are exemplified. In the suspension polymerization method, firstly, a polymerizable monomer, a colorant, and where necessary, other additives are mixed to give a polymerizable monomer composition, and the composition is dispersed in an aqueous dispersion medium containing a dispersion stabilizer. Secondly, a high shear is applied to the aqueous dispersion medium in which the polymerizable monomer composition has been dispersed by using, for example, a high-speed agitator, such that droplets of the polymerizable monomer composition are formed. Thereafter, the aqueous dispersion medium in which the polymerizable monomer composition formed into droplets has been dispersed is polymerized in the presence of a polymerization initiator, and then subjected to filtration by a filtration material, washing and drying to give colored resin particles. Furthermore, external additives such as inorganic microparticles are mixed with these colored resin particles to give a polymerized toner.

In the case when colored resin particles are obtained by a polymerization method in such way, the method has great advantages that spherical colored resin particles can be formed with a smaller particle diameter than the particle diameter in a conventional pulverizing method in a stage of forming particles (it is a stage of forming droplets and conducting polymerization in the polymerization method, whereas it is a stage of conducting pulverization in the pulverizing method), and that a particle diameter distribution can be made sharper.

However, in recent years, in accordance with the further increasing of the required levels of high definition and high image quality, problems that should be solved are pointed out even in a polymerized toner.

In order to impart necessary friction chargeability to a negatively-chargeable toner, a charge control agent is generally added. As charge control agents, metal complexes of salicyclic acid or naphthoic acid with, for example, cobalt, chromium or iron, have been used. However, since charge control agents show high ionicity, there is a problem that a charge control agent is easily present in the vicinity of the surfaces of colored resin particles and thus, for example, fog easily occurs, in the production of a toner by a polymerization method.

In order to solve the above-mentioned problem, prevention of the presence of a charge control agent in the vicinity of the surfaces of colored resin particles more than required, by enhancing compatibilization with a binder resin by using a resin having negative chargeability (a negative-charging controlling resin) has also been suggested. Patent Literatures 1 to 3 each discloses that a resin having sulfonic acid group-containing monomer units within a specific range and having a weight average molecular weight within a specific range is utilized as a negative-charging controlling resin. Furthermore, Patent Literature 4 discloses that two negative-charging controlling resins having different sulfonic acid group-containing monomer units are used in combination.

CITATION LIST

Patent Literature

Patent Literature 1: Japanese Patent Application Laid-Open (JP-A) No. H11-184165

Patent Literature 2: JP-A No. H11-288129

Patent Literature 3: JP-A No. H11-327208

Patent Literature 4: JP-A No. 2009-168963

However, when the toners of the above-mentioned patent literatures are considered, such toners lead to suppression of fog, but there are problems that the minimum fixing temperature is still high, the thin-line reproducibility is poor, and the particle diameter distribution is broaden due to the ionicity of a charge controlling resin when the toner is produced by a polymerization method.

SUMMARY OF INVENTION

Technical Problem

The problems of the present invention are to provide a method for producing a negatively-chargeable toner that solves the above-mentioned problem and has a narrow particle diameter distribution even when produced by a polymerization method, and to provide a toner that is excellent in balance between low-temperature fixability and heat-resistant shelf stability, has fine thin-line reproducibility, and generates little fog, even in high-speed printing.

Solution to Problem

The present invention carried out intensive studies so as to solve the above-mentioned problems, and consequently found that the above-mentioned problems can be solved by using a charge control agent having sulfonic acid-containing monomer units in a specific range and using a specific compound as a softening agent.

That is, according to the present invention, there is provided a negatively-chargeable toner including colored resin particles which contain at least a binder resin, colorant, a charge control agent and a softening agent, wherein the charge control gent is a copolymer which is obtained by copolymerizing a vinyl aromatic hydrocarbon, a (meth) acrylate and a sulfonic acid group-containing (meth)acrylamide and in which a copolymerization ratio of the sulfonic acid group-containing (meth)acrylamide is 0.8 to 4.0% by mass, and wherein the softening agent is at least one of a monoester compound and a polyglycerol ester compound.

It is preferable that the colorant in the negative-chargeable toner of the present invention is carbon black.

It is preferable that an amount of the softening agent in the negatively-chargeable toner of the present invention is 1 to 25 parts by mass with respect to 100 parts by mass of the binder resin.

It is preferable that a weight average molecular weight of the charge control agent in the negatively-chargeable toner of the present invention is 5,000 to 30,000.

It is preferable that an amount of the charge control agent in the negatively-chargeable toner of the present invention is 0.1 to 8 parts by mass with respect to 100 parts by mass of the binder resin.

Furthermore, according to the present invention, there is provided a method for producing a negatively-chargeable toner, the method including a suspension step in which, by suspending a polymerizable monomer composition which contains at least a polymerizable monomer, a colorant, a charge control agent and a softening agent in an aqueous dispersion medium which contains a dispersion stabilizer, a suspension in which droplets of the polymerizable monomer composition are dispersed is obtained, and a step of obtaining colored resin particles by carrying out suspension polymerization using the suspension in the presence of a polymerization initiator, wherein, in the suspension step, a copolymer which is obtained by copolymerizing a vinyl aromatic hydrocarbon, a (meth)acrylate and a sulfonic acid group-containing (meth)acrylamide and in which a copolymerization ratio of the sulfonic acid group-containing (meth) acrylamide is 0.8 to 0.4% by mass, is used as the charge control agent, and wherein, in the suspension step, at least one of a monoester compound and a polyglycerol ester compound is used as a softening agent.

It is preferable that an amount of the softening agent in the method for producing a negatively-chargeable toner of the present invention is 1 to 25 parts by mass with respect to 100 parts by mass of the polymerizable monomer.

It is preferable that a weight average molecular weight of the charge control agent in the method for producing a negatively-chargeable toner of the present invention is 5,000 to 30,000.

It is preferable that an amount of the charge control agent in the method for producing a negatively-chargeable toner of the present invention is 0.1 to 8 parts by mass with respect to 100 parts by mass of the polymerizable monomer.

Advantageous Effects of Invention

According to the present invention as mentioned above, a negatively-chargeable toner in which the low-temperature fixability, heat-resistant shelf stability and thin-line reproducibility of the toner have been improved, and which hardly causes fog, is provided by incorporating a specific copolymer as a charge control agent and incorporating a specific monoester compound and/or a specific polyglycerol ester compound as softening agent(s). Furthermore, according to the production method of the present invention as mentioned above, the above-mentioned negatively-chargeable toner having relatively homogeneous particle diameters and excellent chargeability can be produced by using the above-mentioned charge control agent and softening agent(s).

DESCRIPTION OF EMBODIMENTS

The negatively-chargeable toner of the present invention is characterized in that it is a negatively-chargeable toner including colored resin particles which contain at least a binder resin, a colorant, a charge control agent and a softening agent, characterized in that the charge control agent is a copolymer obtained by copolymerizing a vinyl aromatic hydrocarbon, a (meth)acrylate and a sulfonic acid group-containing (meth)acrylamide and in which a copolymerization ratio of the sulfonic acid group-containing (meth) acrylamide is 0.8 to 4.0% by mass, and characterized in that the softening agent is at least one of a monoester compound and a polyglycerol ester compound.

The method for producing a negatively-chargeable toner of the present invention is characterized in that it is a method for producing a negatively-chargeable toner, the method including a suspension step in which, by suspending a polymerizable monomer composition which contains at least a polymerizable monomer, a colorant, a charge control agent and a softening agent in an aqueous dispersion medium which contains a dispersion stabilizer, a suspension in which droplets of the polymerizable monomer composition are dispersed is obtained, and a step of obtaining colored resin particles by carrying out suspension polymerization using the suspension in the presence of a polymerization initiator, characterized in that, in the suspension step, a copolymer which is obtained by copolymerizing a vinyl aromatic hydrocarbon, a (meth)acrylate and a sulfonic acid group-containing (meth)acrylamide and in which a copolymerization ratio of the sulfonic acid group-containing (meth) acrylamide is 0.8 to 4.0% by mass, and is used as the charge control agent, and characterized in that, in the suspension step, at least one of a monoester compound and a polyglycerol ester compound is used as the softening agent.

In the present invention, it is deemed that the expression "(meth)acrylate" collectively refers to both acrylate and methacrylate. Furthermore, in the present invention, it is deemed that the expression "(meth)acrylamide" collectively refers to both acrylamide and methacrylamide.

Hereinafter the negatively-chargeable toner of the present invention (hereinafter sometimes simply referred to as "toner") will be explained.

The toner of the present invention contains colored resin particles containing a binder resin, a colorant, a charge control agent and a softening agent.

The method for producing the colored resin particles used in the present invention, the colored resin particles obtained by this production method, and the method for producing the toner of the present invention using the colored resin particles, and the toner of the present invention will be explained below in this order.

1. Method for Producing Colored Resin Particles

The colored resin particles used in the present invention are produced by a suspension polymerization method including the processes shown below.

(1) Step of Preparing Polymerizable Monomer Composition

Firstly, a polymerizable monomer, a colorant, a charge control agent and a softening agent, and other additives that are added as necessary such as a molecular weight modifier are mixed to prepare a polymerizable monomer composition. The mixing in the preparation of the polymerizable monomer composition is carried out by using, for example, a media type dispersing machine.

In the present invention, the polymerizable monomer means a monomer having a polymerizable functional group, and the polymerizable monomer is polymerized to be a binder resin. As a main component of the polymerizable monomer, a monovinyl monomer is preferably used. Examples of the monovinyl monomer include: styrene; styrene derivatives such as vinyl toluene and α-methylstyrene; acrylic acid and methacrylic acid; acrylic acid esters such as method acrylate, ethyl acrylate, propyl acrylate, butyl acrylate, 2-ethylhexyl acrylate and dimethylaminoethyl acrylate; methacrylic acid esters such as method methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and acrylate acid esters or methacrylic acid esters are preferably used for the monovinyl monomer.

In order to improve the hot offset and heat-resistant shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids having a carbon-carbon double bond are esterified to alcohol having two or more hydroxyl groups; other divinyl compounds such as N,N-divinylaniline and divinyl ether; and compounds having three or more vinyl groups. These crosslinkable polymerizable monomers can be used along or in combination of two or more kinds.

In the present invention, it is desirable that the amount of the crosslinkable polymerizable monomer to be used is generally in the range of 0.1 to 5 parts by mass, preferably from 0.3 to 2 parts by mass, with respect to 100 parts by mass of the monovinyl monomer.

Further, it is preferable to use a macromonomer as a part of the polymerizable monomer since the balance of the shelf stability and low-temperature fixability of the toner to be obtained is improved. The macromonomer is a reactive oligomer or polymer having a polymerizable carbon-carbon unsaturated double bond at the end of a polymer chain and generally having a number average molecular weight of 1,000 to 30,000. A preferable macromonomer is one capable of providing a polymer having a higher glass transition temperature (hereinafter may be referred to as "Tg") than the glass transition temperature of a polymer obtained by the polymerization of the monovinyl monomer. The macromonomer to be used is preferably in the range from 0.03 to 5 parts by mass, more preferably from 0.05 to 1 part by mass, with respect to 100 parts by mass of the monovinyl monomer.

In the present invention, a colorant is used. To produce a color toner, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used include compounds including ago pigments such as monoazo pigments and disazo pigments, and condensed polycyclic pigments. The specific examples include C. I. Pigment Red 31, 48, 57:1, 68, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269, and C. I. Pigment Violet 19.

In the present invention, the respective colorants can be used alone or in combination of two or more kinds. The amount of the colorant is preferably 1 to 10 parts by mass with respect to 100 parts by mass of the monovinyl monomer.

The colored resin particles used in the present invention contains, as the softening agent, a monoester compound and/or a polyglycerol ester compound.

It is preferable that the monoester compound used in the present invention has the following Formula (1).

$$R^1—COO—R^2 \quad (1)$$

(In the above-mentioned Formula (1), $R^1$ represents a linear alkyl group having 15 to 23 carbons, and $R^2$ represents a linear alkyl group having 16 to 24.)

$R^1$ and $R^2$ may be the same group, or may be groups that are different from each other.

In the monoester compound shown in Formula (1), the difference between the number of the carbons in the raw material fatty acid (that is, a carbon number obtained by adding 1 to the carbon number of $R^1$) and the carbon number in the raw material alcohol (that is, the carbon number of $R^2$) is preferably from 0 to 6, more preferably from 2 to 6, further preferably from 4 to 6.

Specific examples of the monoester compound shown in Formula (1) include eicosyl palmitate ($C_{15}H_{31}$—COO—$C_{20}H_{41}$), behenyl palmitate ($C_{15}H_{31}$—COO—$C_{22}H_{45}$), stearyl stearate ($C_{17}H_{35}$—COO—$C_{18}H_{37}$), eicosyl stearate ($C_{17}H_{35}$—COO—$C_{20}H_{41}$), behenyl stearate ($C_{17}H_{35}$—COO—$C_{22}H_{45}$), hexadecyl eicosanoate ($C_{19}H_{39}$—COO—$C_{16}H_{33}$), stearyl eicosanoate ($C_{19}H_{39}$—COO—$C_{18}H_{37}$), eicosyl eicosanoate ($C_{19}H_{39}$—COO—$C_{20}H_{41}$), hexadecyl behenate ($C_{21}H_{43}$—COO—$C_{16}H_{33}$), stearyl behenate ($C_{21}H_{43}$—COO—$C_{10}H_{37}$), eicosyl behenate ($C_{21}H_{43}$—COO—$C_{20}H_{41}$), behenyl behenate ($C_{21}H_{43}$—COO—$C_{22}H_{45}$) and hexadecyl lignocerate ($C_{23}H_{47}$—COO—$C_{16}H_{33}$). Among these monoester compounds, the monoester compounds are more preferably behenyl palmitate, eicosyl palmitate, behenyl stearate, eicosyl eicosanoate, hexadecyl behenate, behenyl stearate and behenyl behenate, and are further preferably behenyl palmitate, behenyl stearate and eicosyl eicosanoate.

In general, the hydroxyl group value of the above-mentioned monoester compound is preferably 10 mg KOH/g or less, more preferably 6 mg KOH/g or less, and further more preferably 3 mg KOH/g or less. If the hydroxyl group value is more than 10 mg KOH/g, the heat-resistant shelf stability may deteriorate. Incidentally, the hydroxyl group value of the monoester compound is a value that is measured in compliant with JIS K 0070, which is a standard fat and oil analysis methodology as prescribed by the Japanese Industrial Standards Committee (JICS).

The melting point of the monoester compound is preferably 60 to 70° C., more preferably 63 to 72° C., further preferably 65 to 70° C. In the case when the melting point of the monoester compound is lower than 60° C., the toner may be poor in heat-resistant shelf stability. Alternatively, in the case when the melting point of the monoester compound is more than 75° C., the low-temperature fixability may deteriorate.

For the melting point of the monoester compound, for example, a measurement is carried out by using, for example, a differential scanning calorimeter (produced by Seiko Instruments, Inc., product name: DSC-6220) under a condition in which the temperature is raised by 100° C./min in a specific temperature range, and the top of the peak in the obtained DSC curve can be set as a melting point (TmD).

Examples of the method for producing the above-mentioned monoester compound include a synthesis method by an oxidation reaction, synthesis from a carboxylic acid and derivatives thereof, an ester group-introducing reaction represented by a Michael addition reaction, a method utilizing a dehydration condensation reaction from a carboxylic acid compound and an alcohol compound, a reaction from an acid halide and an alcohol compound, and a transesterification reaction. For the production of these monoester compounds, a catalyst can be suitably used. As the catalyst, general acidic or alkaline catalysts that are used in esterification reactions such zinc acetate and titanium compounds are preferable. After the esterification reaction, the intended product may be purified by, for example, recrystallization or distillation.

Typical examples of the method for producing the monoester compound are as follows. Incidentally, the method for producing the monoester compound used in the present invention is not limited to the following typical examples.

Firstly, an alcohol and a carboxylic acid as raw materials are added to a reaction vessel. The molar ratio of the alcohol to the carboxylic acid is suitably adjusted in line with the chemical structure of the intended softening agent. That is, in the case of the monoester compound, the alcohol and the carboxylic acid are mixed so as to have a molar ratio of alcohol:carboxylic acid=1:1. Incidentally, with consider for, for example, the reactivity in a dehydration condensation reaction, either one of the alcohol and the carboxylic acid may be added slightly excessively over the above-mentioned ratio.

Secondly, dehydration condensation reaction is carried out by suitably heating the mixture. A basic aqueous solution and a suitable organic solvent are added to the esterified crude product obtained by the dehydration condensation reaction, and the unreacted alcohol and carboxylic acid are deprotonated and separated into an aqueous phase. Then suitable water washing, distillation of the solvent and filtration are carried out, such that a desired monoester compound can be obtained.

The polyglycerol ester compound (polyglycerol ester wax) used in the present invention is preferably an ester of a polyglycerol and an fatty acid. By using the polyglycerol ester compound as the softening agent, the low-temperature fixability, heat-resistant shelf stability and thin-line reproducibility, and durability after leaving at a high temperature of the obtained toner can be enhanced.

The polyglycerol is formed by dehydration condensation of glycerol, and the polymerization degree thereof is preferably 3 to 15, more preferably 4 to 12, further preferably 5 to 9. In the case when the polymerization degree of the polyglycerol is lower than 3, the heat-resistant shelf stability and the durability after leaving at a high temperature of the obtained toner may deteriorate. On the other hand, in the case when the polymerization degree of the polyglycerol is more than 15, the effect of the low-temperature fixability may be lowered, and the mold release property may be lost.

The fatty acid group that constitutes the above-mentioned polyglycerol ester compound is preferably a saturated fatty acid group having 10 to 28 carbons, more preferably a saturated aliphatic acid group having 14 to 24 carbons, further preferably a saturated aliphatic acid group having 18 to 22 carbons.

Specific examples of the above-mentioned polyglycerol ester compound include hexaglycerol octabehenate, hexaglycerol tetrabehentate tetrapalmitate, pentaglycerol heptabehenate, tetraglycerol hexabeheneate and triglycerol pentabehenate. Among these polyglycerol ester compounds, in the present invention, hexaglycerol octabehentate, hexaglycerol tetrabehenate tetrapalmitate, pentaglycerol heptabehenate and tetraglycerol hexabehenate are more preferable, and hexaglycerol octabehenate and hexaglycerol tetrabehenate tetrapalmitate are further preferable.

These polyglycerol ester compounds may be used alone or in combination of two or more kinds.

Generally, the hydroxyl group value of the above-mentioned polyglycerol ester compound is preferably 20 mg KOH/g or less, more preferably 6 mg KOH/g or less, and further preferably 3 mg KOH/g or less. If the hydroxyl group value is more than 20 mg KOH/g, the heat-resistant shelf stability may deteriorate. Incidentally, the hydroxyl group value of the polyglycerol ester compound can be measured in a similar manner to that for the hydroxyl group value of the above-mentioned monoester compound.

The melting point of the above-mentioned polyglycerol ester compound is preferably 60 to 75° C., more preferably 63 to 72° C., further preferably 65 to 70° C. In the case when the melting point of the polyglycerol ester compound is lower than 60° C., the toner may be poor in heat-resistant shelf stability. Alternatively, in the case when the melting point of the polyglycerol ester compound is more than 75° C., the low-temperature fixability may deteriorate.

The melting point of the polyglycerol ester compound can be measured in a similar manner to that for the melting point of the above-mentioned monoester compound.

Examples of the method for producing the above-mentioned polyglycerol ester compound include a synthesis method by an oxidation reaction, synthesis from a carboxylic acid and derivatives thereof, an ester group-introducing reaction represented by a Michael addition reaction, a method utilizing a dehydration condensation reaction from a carboxylic acid compound and an alcohol compound, a reaction from an acid halide and an alcohol compound, and a transesterification reaction. For the production of these polyglycerol ester compounds, a catalyst can be suitably used. As the catalyst, general acidic or alkaline catalysts that are used in esterification reactions such as zinc acetate and titanium compounds are preferable. After the esterification reaction, the intended product may be purified by, for example, recrystallization or distillation.

Typical examples of the polyglycerol ester compound are as follows. Incidentally, the method for producing the polyglycerol ester compound used in the present invention is not limited to the following typical examples.

Firstly, a polyglycerol and a carboxylic acid as raw materials are added to a reaction vessel. The molar ratio of the polyglycerol to the carboxylic acid is appropriately adjusted in accordance with the chemical structure of an objective softening agent. That is, in the case when, for example, a hexaglycerol (this has eight hydroxyl groups) is used as the polyglycerol, the hexaglycerol and the carboxylic acid are mixed so as to give a molar ratio of hexaglycerol:carboxylic acid=1:8. Incidentally, with consideration for the reactivity in a dehydration condensation reaction, either one of the polyglycerol and the carboxylic acid may be added slightly excessively over the above-mentioned ratio.

Secondly, dehydration condensation reaction is carried out by suitably heating the mixture. A basic aqueous solution and a suitable organic solvent are added to the esterified crude product obtained by the dehydration condensation reaction, and the unreacted polyglycerol and carboxylic acid are deprotonated and separated into an aqueous phase. Then suitable water washing, distillation of the solvent and filtration are carried out, such that a desired polyglycerol ester compound can be obtained.

The monoester compound and polyglycerol ester compound as the softening agents respectively show similar contribution to the expression of the effect of the present invention, and in the case when these compounds are used in combination, there is an advantage that low-temperature fixability and thin-line reproducibility can further be enhanced together.

The content of the softening agent is generally 1 to 30 parts by mass, preferably 1 to 25 parts by mass with respect to 100 parts by mass of the polymerizable monomer (preferably a monovinyl monomer). In the case when two or more kinds of softening agents are used, the total content of the all softening agents is generally 1 to 30 parts by mass, preferably 1 to 25 parts by mass with respect to 100 parts by mass of the polymerizable monomer. In the case when the content is lower than 1 part by mass, the low-temperature fixability of the obtained toner may deteriorate. On the other hand, in the case when the content is more than 30 parts by mass, the heat-resistant shelf stability of the obtained toner may deteriorate.

In the case when a monoester compound is used as the softening agent, the content of the monoester compound is preferably 10 to 25 parts by mass, more preferably 12 to 22 parts by mass, further preferably 15 to 20 parts by mass with respect to 100 parts by mass of the polymerizable monomer.

In the case when a polyglycerol ester compound is used as the softening agent, the content of the polyglycerol ester compound is preferably 1 to 20 parts by mass, more preferably 2 to 10 parts by mass, further preferably 3 to 8 parts by mass with respect to 100 parts by mass of the polymerizable monomer.

Furthermore, in the case when the above-mentioned polyglycerol ester compound is used as the softening agent, it is preferable to use a hydrocarbon wax such as a paraffin wax in combination.

Examples of the above-mentioned hydrocarbon wax include a polyethylene wax, a polypropylene wax, a Fisher-Tropsch wax and a petroleum-based wax, and among these, a Fischer-Tropsch wax and a petroleum-based wax are preferable, and a petroleum-based wax is more preferable.

The number average molecular weight of the hydrocarbon wax is preferably 300 to 800, more preferably 400 to 600. Furthermore, the penetration of the hydrocarbon wax measured by JIS K2235 5.4 is preferably 1 to 10, more preferably 2 to 7.

The above-mentioned "petroleum-based wax" refers to petroleum-based waxes that are produced from a step of purifying petroleum and are solids at room temperature containing a saturated hydrocarbon having side chains as a major component, and are roughly classified into three kinds: a paraffin wax, a microstalline wax and petroleum in JIS K 2235. In the present invention, it is preferable to select and use at least one kind from these three kinds. Furthermore, among petroleum-based waxes, a paraffin wax and a microstalline wax are more preferable from the viewpoint that the balance between the low-temperature fixability and shelf stability of the toner is made preferable.

The content of the hydrocarbon wax is generally 0.5 to 10 parts by mass with respect to 100 parts by mass of the polymerizable monomer (preferably a monovinyl monomer). In the case when the content is lower than 0.5 parts by mass, the low-temperature fixability of the obtained toner may deteriorate. On the other hand, in the case when the content is more than 10 parts by mass, the heat-resistant shelf stability of the obtained toner may deteriorate.

The content of the hydrocarbon wax is preferably 1 to 8 parts by mass, more preferably 2 to 6 parts by mass with respect to 100 parts by mass of the polymerizable monomer.

Furthermore, the total content of the polyglycerol ester compound and hydrocarbon wax is preferably 1.5 to 30 parts by mass, more preferably 3 to 20 parts by mass, and further preferably 5 to 10 parts by mass with respect to 100 parts by mass of the polymerizable monomer (preferably a monovinyl monomer).

The number of average molecular weight of the hydrocarbon wax is preferably 300 to 800, more preferably 400 to 600. Furthermore, the penetration of the hydrocarbon wax measured by JIS K2235 5.4 is preferably 1 to 10, more preferably 2 to 7.

In the present invention, as the charge control agent, a sulfonic acid group-containing copolymer obtained by copolymerizing a vinyl aromatic hydrocarbon, a (meth)acrylate and a sulfonic acid group-containing (meth)acrylamide. This sulfonic acid group-containing copolymer is sometimes referred to as a charge controlling resin. The sulfonic acid group-containing copolymer is colorless to the extent that is sufficient to obtain a color toner. By copolymerizing the sulfonic acid group-containing (meth)acrylamide, sulfonic acid groups are incorporating in the copolymer, such that the sulfonic acid group-containing copolymer can be used as a negatively-chargeable charge control agent. The copolymerization ratio of the sulfonic acid group-containing (meth) acrylamide in the sulfonic acid group-containing copolymer needs to be within the range of 0.8 to 4.0% by mass, and is preferably within the range of 1.0 to 3.5% by mass, further preferably within the range of 1.5 to 3% by mass. If the copolymerization ratio of the sulfonic acid group-containing (meth)acrylamide is lower than 0.8% by mass, the effect to impart negative-chargeability is small, conversely, when the copolymerization ratio is more than 4.0% by mass, the dispersion stability of the droplets of the polymerizable monomer composition during the polymerization decreases, and thus a polymerized toner having a homogeneous particle diameter cannot be obtained. Furthermore, if the copolymerization ratio of the sulfonic acid group-containing (meth)

acrylamide is either too small or too high, the environmental stability of the image quality is deteriorated.

Incidentally, in the present invention, the sulfonic acid group also encompasses a salt thereof (a sulfonate group).

The copolymerization ratio (% by mass) of the sulfonic acid group-containing (meth)acrylamide in the sulfonic acid group-containing copolymer can be calculated by measuring a sulfur content by an elemental analysis by, for example, a fluorescence X-ray analysis (XRF), and calculating the copolymerization ratio from the result thereof.

Furthermore, in the case when a sulfonic acid group-containing copolymer is synthesized, a value obtained by dividing the mass of the used sulfonic acid group-containing (meth)acrylamide with the total mass of the vinyl aromatic hydrocarbon, the (meth)acrylate and the sulfonic acid group-containing (meth)acrylamide can be set as the copolymerization ratio (% by mass) of the sulfonic acid group-containing (meth)acrylamide in the sulfonic acid group-containing copolymer.

By copolymerizing the vinyl aromatic hydrocarbon, the sulfonic acid group-containing copolymer can be stably obtained. By adjusting the copolymerization ratio of the vinyl aromatic hydrocarbon and the (meth)acrylate, the glass transition temperature (Tg) of the sulfonic acid group-containing copolymer can be controlled to be within a desired range, and by this way, the fixing temperature can be made relatively low without deteriorating the heat-resistant shelf stability. Furthermore, by using the vinyl aromatic hydrocarbon and the (meth)acrylate in combination, the compatibility between the sulfonic acid group-containing copolymer and the polymer component in the polymerized toner can be improved, and thus a polymerized toner that is homogeneous in chargeability and other various properties can be formed. The copolymerization ratio (mass basis) of the vinyl aromatic hydrocarbon to the (meth)acrylate is generally 99:1 to 50:50, preferably 95:5 to 70:30.

The weight average molecular weight (Mw) of the sulfonic acid group-containing copolymer used in the present invention should be in the range of 5,000 to 30,000 by a value in terms of polystyrene measured by gel permeation chromatography (GPC) using tetrahydrofuran, and is within the range of preferably 8,000 to 25,000, more preferably 10,000 to 20,000. If the weight average molecular weight of the sulfonic acid group-containing copolymer is too large, the sizes of the droplet of the polymerizable monomer composition become nonhomogeneous during the polymerization, and thus a polymerized toner having homogeneous particle diameters is difficult to be obtained, and eventually, the fluidity and heat-resistant shelf stability show a tendency to decrease, the environmental dependency and durability of the image quality are also deteriorated, and it becomes difficult to lower the fixing temperature. If the weight average molecular weight of the sulfonic acid group-containing copolymer is too small, the fluidity of the obtained polymerized toner becomes insufficient, the heat-resistant shelf stability decreases, and the environmental dependency and durability of the image quality also show a tendency to become poor. The raw materials and production method of the sulfonic acid group-containing copolymer used in the present invention will be mentioned below in detail.

The vinyl aromatic hydrocarbon used for the production of the sulfonic acid group-containing copolymer is a compound (monomer) having a structure in which a vinyl group is bonded to an aromatic hydrocarbon, and specific examples include styrene, α-methylstryrene, 2-methylstyrene, 3-methylstyrene, 4-methylstyrene, 2-ethylstyrene, 3-ethylstyrene, 4-ethylstyrene, 2-propylstyrene, 3-propylstyrene, 4-propylstyrene, 2-isopropylstyrene, 3-isopropylstyrene, 4-isopropylstyrene, 2-chlorostyrene, 3-chlorostyrene, 4-chlorostyrene, 2-methyl-α-methylstyrene, 3-methyl-α-methylstyrene, 4-methyl-α-methylstyrene, 2-ethyl-α-methylstyrene, 3-ethyl-α-methylstyrene, 4-ethyl-α-methylstyrene, 2-propyl-α-methylstyrene, 3-propyl-α-methylstyrene, 4-propyl-α-methylstyrene, 2-isopropyl-α-methylstyrene, 3-isopropyl-α-methylstyrene, 4-isopropyl-α-methylstyrene, 2-chloro-α-methylstyrene, 3-chloro-α-methylstyrene, 4-chloro-α-methylstyrene, 2,3-dimethylstyrene, 3,4-dimethylstyrene, 2,4-dimethylstyrene, 2,6-dimethylstyrene, 2,3-diethylstyrene, 3,4-diethylstyrene, 2,4-diethylstyrene, 2,6-diethylstyrene, 2-methyl-3-ethylstyrene, 2-methyl-4-ethylstyrene, 2-chloro-4-methylstyrene, 2,3-dimethyl-α-methylstyrene, 3,4-dimethyl-α-methylstyrene, 2,4-dimethyl-α-methylstyrene, 2,6-dimethyl-α-methylstyrene, 2,3-diethyl-α-methylstyrene, 3,4-diethyl-α-methylstyrene, 2,4-diethyl-α-methylstyrene, 2,6-diethyl-α-methylstyrene, 2-ethyl-3-methyl-α-methylstyrene, 2-methyl-4-propyl-α-methylstyrene and 2-chloro-4-ethyl-α-methylstyrene. Each of these vinyl aromatic hydrocarbons can be used along, or these vinyl aromatic hydrocarbons can be used by combining two or more kinds.

The (meth)acrylate used in the production of the sulfonic acid group-containing copolymer is an acrylic acid ester or a methacrylic acid ester, and specific examples include acrylic acid esters such as methyl acrylate, ethyl acrylate, propyl acrylate, isopropyl acrylate, n-butyl acrylate, isobutyl acrylate, n-amyl acrylate, isomyl acrylate, n-hexyl acrylate, 2-ethylhexyl acrylate, hydroxypropyl acrylate and lauryl acrylate; and methacrylic acid esters such as methyl methacylate, ethyl methacrylate, propyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, hydroxypropyl methacrylate and lauryl methacrylate. Each of these (meth) acrylates can be used alone, or these (meth)acrylates can be used by combining two or more kinds.

As the sulfonic acid group-containing (meth)acrylamide for use in the production of the sulfonic acid group-containing copolymer, for example, 2-acrylamide-2-methylpropanesulfonic acid, 2-acrylamide-n-butanesulfonic acid, 2-acrylamide-n-hexanesulfonic acid, 2-acrylamide-n-octanesulfonic acid, 2-acrylamide-n-docedanesulfonic acid, 2-acrylamide-n-tetradecanesulfonic acid, 2-acrylamide-2-methylpropanesulfonic acid, 2-acrylamide-2,2,4-trimethylpentanesulfonic acid, 2-acrylamide-2-methylphenylethanesulfonic acid, 2-acrylamide-2-(4-chlorophenyl) propanesulfonic acid, 2-acrylamide-2-carboxymethylpropanesulfonic acid, 2-acrylamide-2-(2-pyridine)propanesulfonic acid, 2-acrylamide-1-methylpropanesulfonic acid, 3-acrylamide-3-methylbutanesulfonic acid, 2-methacrylamide-n-decanesulfonic acid and 4-methacrylamidebenzenesulfonic acid can be exemplified. Each of these sulfonic acid group-containing (meth)acrylamides can be used alone, or two or more kinds of these sulfonic acid group-containing (meth) acrylamides can be used in combination.

The sulfonic acid group-containing copolymer used in the present invention can be obtained by copolymerizing the respective monomer components by an optional polymerization method such as emulsification polymerization, dispersion polymerization, suspension polymerization or solution polymerization. Among these polymerization methods, a solution polymerization method is preferable since the copolymerization ratio and the weight average molecular weight are easily adjusted. As the polymerization initiator for use in the production of the sulfonic acid group-containing copolymer, azo compounds such as 2,2'-azobisisobutyronitrile, 2,2'-azobis(4-methoxy-2,4-dimethylvaleronitrile), 2,2'-azobisisobutylate, 4,4'-azobis(4-cyanopentanoic acid), 4,4'-azobis(4-cyanovaleric acid), 2,2'-azobis(2-amidinopropane) dibasic acid, 2,2-azobis-2-methyl-N-1,1-bis(hydroxymethyl)-2-hydroxydiethylpropionamide and 1,1'-azobis(1-cyclohexanecarbonitrile); diamine compounds such as 2,2'-azobis(2-amidinopropane)dihydrochloride, 2,2'-azobis (N,N'-dimethyleneisobutylamidine) and 2,2'-azobis(N,N'-dimethyleneisobutylamidine)dihydrochloride; peroxide such as methylethylperoxide, di-t-butylperoxide, acetylperoxide, dicymylperoxide, luroylperoxide, benzoylperoxide, t-butylperoxy-2-ethylhexanoate, di-isopropylperoxydicarbonate and di-t-butylperoxyisophthalate, can be exemplified.

The use amount of the polymerization initiator can be arbitrarily selected depending on the intended weight average molecular weight, and is generally 0.01 to 10 parts by mass, preferably 0.1 to 5 parts by mass with respect to 100 parts by mass of the monomer whole amount. In solution polymerization, an anion polymerization initiator such as an alkali metal, butyl lithium, or a reaction product of an alkali metal and naphthalene can also be used.

The solvent and dispersant that are used in, for example, solution polymerization can be suitably selected. Specific examples of the hydrocarbon compound include aromatic hydrocarbon-based compounds such as benzene, toluene and xylene; and saturated hydrocarbon-based organic compounds such as n-hexane, cyclohexane, methylcyclohexane, ethylcyclohexane, nonane, decane, decaline and dodecane. Examples of the oxygen-containing organic compound include compounds having hydroxyl groups such as methanol, ethanol, n-propyl alcohol, isopropyl alcohol, n-butyl alcohol, isobutylalcohol, sec-butyl alcohol, amyl alcohol, isoamyl alcohol, methylisobutylcarbinol, 2-ethylbutanol, 2-ethylhexanol, cyclohexanol, furfuryl alcohol, tetrahydrofurfuryl alcohol, ethylene glycol, hexylene glycol and glycerol; aliphatic saturated ethers such as propyl ether, isopropyl ether, butyl ether, isobutyl ether, n-amyl ether, isoamyl ether, methyl butyl ether, methyl isobutyl ether, methyl n-amyl ether, methyl isoamyl ether, ethyl propyl ether, ethyl isopropyl ether, ethyl butyl ether, ethyl isobutyl ether, ethyl n-amyl ether and ethyl isoamyl ether; aliphatic unsaturated ethers such as allyl ether and ethyl allyl ether; aromatic ethers such as anisole, phenethol, phenyl ether and benzyl ether; cyclic ethers such as tetrahydrofuran, tetrahydropyran and dioxane; ethylene glycols such as ethylene glycol monomethyl ether, ethylene glycol monoethyl ether, ethylene glycol monobutyl ether, diethylene glycol monomethyl ether, diethylene glycol monoethyl ether and diethylene glycol monobutyl ether; organic acids such as formic acid, acetic acid, acetic anhydride and butylic acid; organic acid esters such as butyl formate, amyl formate, propyl acetate, isopropyl acetate, butyl acetate, sec-butyl acetate, amyl acetate, isoamyl acetate, 2-ethylhexyl acetate, cyclohexyl acetate, butylcyclohexyl acetate, ethyl propionate, butyl propionate, amyl propionate, butyl butyrate, diethyl carbonate, diethyl oxalate, methyl lactate, ethyl lactate, butyl lactate and triethyl phosphate; ketones such as methyl isopropyl ketone, methyl isobutyl ketone, ethyl isobutyl ketone, diisobutyl ketone, acetylacetone, diacetone alcohol, cyclohexanone, cyclopentanone, methylcyclohexanone and cycloheptanone; and other oxygen-containing organic compounds such as 1,4-dioxane, isophoron and furfural.

The polymerization temperatures and polymerization time can be arbitrarily selected depending on, for example, the polymerization method and the kind of the used polymerization initiator, and is generally about 50 to 200° C., and the polymerization time is bout 0.5 to 20 hours. In the polymerization, generally-known additives, for example, polymerization aids such as amines can be used in combination. As the method for collecting the sulfonic acid group-containing copolymer from the system after the polymerization, a method for precipitating the copolymer by adding a poor solvent, a method for removing the solvent by means of steam, a method for removing the solvent by means of under a reduced pressure, a method for removing the solvent by means of heat-melting, a method for freeze drying, and a method for polymerizing at a high concentration and then directly adding the polymer to a toner polymerization system are used.

The content of the charge control agent is generally 0.1 to 8 parts by mass, preferably 0.2 to 5 parts by mass, further preferably 0.3 to 3 parts by mass with respect to 100 parts by mass of the polymerizable monomer (preferably a monovinyl monomer). If the charge control agent is less than 0.1 parts by mass, charging may be insufficient and thus fog may generate, and conversely, if the charge control agent is more than 8 parts by mass, fog may generate under a low temperature-low humidity environment.

As one of other additives, a molecular weight modifier is preferably used upon the polymerization of the polymerizable monomer which is polymerized to be a binder resin.

The molecular weight modifier is not particularly limited as long as it is generally used as a molecular weight modifier for a toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuran disulfide, tetraethyl thiuram disulfide, tetrabutyl thiuram disulfide, N,N'-dimethyl-N,N'-diphenyl thiuram and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally in the range from 0.01 to 10 parts by mass, more preferably from 0.1 to 5 parts by mass, with respect to 100 parts by mass of the monovinyl monomer.

(2) Suspension Process of Obtaining Suspension (Droplets Forming Process)

In the present invention, the polymerizable monomer composition including at least a polymerizable monomer, a colorant, a charge control agent and a softening agent is dispersed in an aqueous dispersion medium containing a dispersion stabilizer, and a polymerization initiator is added therein, and the droplets of the polymerizable monomer composition are then formed. The method for forming the droplets is not particularly limited, and for example, the droplets are formed by means of a device capable of strong stirring such as an in-line type emulsifying and dispersing machine (product name: MILDER; manufactured by Pacific Machinery & Engineering Co., Ltd), and a high-speed emulsification dispersing machine (product name: T. K. HOMOMIXER MARK II; manufactured by PRIMIX Corporation).

Examples of the polymerization initiator include: persulfates such as potassium persulfate and ammonium persulfate; azo compounds as 4,4'-azobis(4-cyanovaleric acid), 2,2'-azobis(2-methyl-N-(2-hydroxyethyl)propionamide), 2,2'-azobis(2-amidinopropane(dihydrochloride, 2,2'-azobis (2,4-dimethylvaleronitrile) and 2,2'-azobisisobutyronitrile; and organic peroxides such as di-t-butylperoxide, benzoylperoxide, t-butylperoxy-2-ethylhexanoate, t-butylperoxydiethylacetate, t-hexylperoxy-2-ethylbutanoate, diisopropylperoxydicarbonate, di-t-butylperoxyisophthalate and t-butylperoxyisobutyrate. These can be used alone or in combination of two or more kinds. Among them, the organic peroxides are preferably used since they can reduce residual polymerizable monomer and can impart excellent printing durability.

Among the organic peroxides, preferred are peroxy esters, and more preferred are non-aromatic peroxy esters, i.e. peroxy esters having no aromatic ring, since they have excellent initiator efficiency and can reduce a residual polymerizable monomer.

The polymerization initiator may be added after dispersing the polymerizable monomer composition to the aqueous dispersion medium and before forming droplets as described above, or may be added to the polymerizable monomer composition before the polymerizable monomer composition is dispersed in the aqueous dispersion medium.

The added amount of the polymerization initiator used in the polymerization of the polymerizable monomer composition is preferably in the range of from 0.1 to 20 parts by mass, more preferably from 0.3 to 15 parts by mass, even more preferably from 1 to 10 parts by mass, with respect to 100 parts by mass of the monovinyl monomer.

In the present invention, the aqueous dispersion medium means a medium containing water as a main component.

In the present invention, the dispersion stabilizer is preferably added to the aqueous dispersion medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used alone or in combination of two or more kinds.

Among the above dispersion stabilizers, colloids of inorganic compounds, particularly hardly water-soluble metal hydroxides are preferable. By using the colloids of inorganic compounds, particularly hardly water-soluble metal hydroxides, the colored resin particles can have a small particle diameter distribution, and the amount of the dispersion stabilizer remained after washing is small, thus an image can be clearly reproduced by the toner to be obtained, and environmental stability can be excellent.

(3) Polymerization Process

After the droplets are formed as described in the above (2), the thus-obtained aqueous dispersion medium is heated to initiate polymerization, thereby an aqueous dispersion of colored resin particles is formed.

The polymerization temperature of the polymerizable monomer composition is preferably 50° C. or more, more preferably in the range of from 60 to 95° C. The polymerization reaction time is preferably in the range from 1 to 20 hours, more preferably in the range from 2 to 15 hours.

The colored resin particles may be used as a polymerized toner obtained by adding an external additive. It is preferable that the colored resin particles are so-called core-shell type (or "capsule type") colored resin particles which are obtained by using each colored resin particle as a core layer and forming a shell layer, a material of which is different from that of the core layer, around the core layer. The core-shell type colored resin particles can take a balance of lowering fixing temperature and prevention of blocking at storage, since the core layer including a substance having a low softening point is covered with a substance having a higher softening point.

A method for producing the above-mentioned core-shell type colored resin particles using the colored resin particles is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer for forming a shell layer (a polymerizable monomer for shell) and a polymerization initiator are added to an aqueous dispersion medium to which the colored resin particles are dispersed followed by polymerization, thus the core-shell type colored resin particles can be obtained.

As the polymerizable monomer for a shell, the above-mentioned polymerizable monomer can be similarly used. Among the polymerizable monomers, any of monomers which provide a polymer having Tg of more than 80° C. such as styrene, acrylonitrile and methyl methacrylate is preferably used along or in combination of two or more kinds.

Examples of the polymerization initiator used for the polymerization of the polymerization monomer for a shell include: water-soluble polymerization initiators including metal persulfates such as potassium persulfate and ammonium persulfate; and azo-type initiators such as 2,2'-azobis (2-methyl-N-(2-hydroxyethyl)propionamide) and 2,2'-azobis(2-methyl-N-(1,1-bis(hydroxymethyl)2-hydroxyethyl) propionamide). These polymerization initiators can be used alone on in combination of two or more kinds. The amount of the polymerization initiator is preferably 0.1 to 30 parts by mass, more preferably 1 to 20 parts by mass, with respect to 100 parts by mass of the polymerizable monomer for shell.

The polymerization temperature of the shell layer is preferably 50° C. or more, more preferably in the range from 60 to 95° C. The polymerization reaction time is preferably in the range from 1 to 20 hours, more preferably from 2 to 15 hours.

(4) Processes of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying several times as needed after the polymerization, according to any conventional method.

In the washing method, if the inorganic compound is used as the dispersion stabilizer, it is preferable that an acid or an alkali is added to the aqueous dispersion of colored resin particles; thereby, the dispersion stabilizer is dissolved in water and removed. If a colloid of a hardly water-soluble inorganic hydroxide is used as the dispersion stabilizer, it is preferable to control the pH of the aqueous dispersion of colored resin particles to 6.5 or less. Examples of the acid to be added include inorganic acids such as sulfuric acid, hydrochloric acid and nitric acid, and organic acids such as formic acid and acetic acid. Particularly, sulfuric acid is preferable for high removal efficiency and small impact on production facilities.

The methods for dehydrating and filtering are not particularly limited, and any of various known methods can be used. Examples of the filtration method can include a centrifugal filtration method, a vacuum filtration method and a pressure filtration method. Also, the drying method is not particularly limited, and any of various methods can be used.

2. Colored Resin Particles

The colored resin particles can be obtained by the above-mentioned suspension polymerization method.

The colored resin particles constituting the toner will be mentioned below. Incidentally, the colored resin particles hereinafter include both core-shell type colored resin particles and colored resin particles which are not core-shell type.

The volume average particle diameter (Dv) of the colored resin particles is preferably 4 to 12 μm, more preferably 5 to 10 μm. If the volume average particle diameter (Dv) of the colored resin particles is less than 4 μm, the flowability of the polymerized toner may lower, the transferability may deteriorate, and the image density may decrease. If the volume average particle diameter (Dv) of the colored resin particles exceeds 12 μm, the resolution of images may decrease.

As for the colored resin particles, a ratio (particle diameter distribution (Dv/Dn)) of the volume average particle diameter (Dv) and the number average particle diameter (Dn) is preferably 1.0 to 1.3, more preferably 1.0 to 1.2. If "Dv/Dn" exceeds 1.3, the transferability, image density and resolution may decrease. The volume average particle diameter and the number average particle diameter of the colored resin particles can be measured, for example, by means of a particle diameter measuring device (product name: MULTISIZER; manufactured by Beckman Coulter, Inc.), etc.

Therefore, in the present invention, a negatively-chargeable toner that has a narrow particle diameter distribution even produced by a polymerization method can be obtained.

The average circularity of the colored resin particles of the present invention is preferably 0.96 to 1.00, more preferably 0.97 to 1.00, even more preferably 0.98 to 1.00, from the viewpoint of image reproducibility.

If the average circularity of the colored resin particles is less than 0.96, the thin-line reproducibility of printing may decrease.

In the present invention, circularity is a value obtained by dividing a perimeter of a circle having an area same as a projected area of a particle by a perimeter of a projected particle image. Also, in the present invention, an average circularity is used as a simple method of quantitatively presenting shapes of particles and is an indicator showing the level of convexo-concave shapes of the colored resin particles. The average circularity is "1" when each of the colored resin particles is an absolute sphere, and the value becomes smaller as the shape of the surface of each of the colored resin particles becomes more complex.

3. Method for Producing Toner of the Present Invention

In the present invention, the colored resin particles are mixed and agitated together with an external additive to allow the external additive to attach to the surface of the colored resin particles to thereby form a one-component toner (developer). Incidentally, the one-component toner may be mixed and agitated together with carrier particles to form a two-component developer.

The agitator for adding an external additive to colored resin particles is not particularly limited as long as it is an agitator capable of attaching the external additive on the surface of the colored resin particles. The examples include agitators capable of mixing and agitating, such as FM Mixer (product name; manufactured by NIPPON COKE & ENGINEERING CO., LTD.), SUPER MIXER (produce name; manufactured by KAWATA Manufacturing Co., Ltd.), Q MIXER (product name; manufactured by NIPPON COKE & ENGINEERING CO., LTD.), Mechanofusion system (product name; manufactured by Hosokawa Micron Corporation) and MECHANOMILL (product name; manufactured by Okada Seiko Co., Ltd.). The external additive can be added to the colored resin particles by means of the above agitators.

Examples of the external additive include: inorganic particles including silica, titanium oxide, aluminum oxide, zinc oxide, tin oxide, calcium carbonate, calcium phosphate and/or cerium oxide; and organic particles including polymethyl methacrylate, silicone resin and/or melamine resin. Among them, inorganic particles are preferable. Among the inorganic particles, silica and/or titanium oxide is preferable, and particles including silica are more preferable.

Incidentally, these external additives are used alone, or in combination of two or more kinds. In particular, it is preferable to use two or more kinds of silica having a different particle diameter in combination.

In the present invention, it is desirable that the amount of the external additive to be used is generally in the range from 0.05 to 6 parts by mass, preferably from 0.2 to 5 parts by mass, with respect to 100 parts by mass of the colored resin particles. If the added amount of the external additive is less than 0.05 part by mass, the toner after transfer may be remained. If the added amount of the external additive exceeds 6 parts by mass, fog may occur.

4. Toner of the Present Invention

The toner obtained via the above-mentioned steps is a toner that is excellent in fixability and fine thin-line reproducibility, generates little fog and having fine heat-resistant shelf stability even in high-speed printing.

EXAMPLES

Hereinafter, the present invention will be described further in detail with reference to examples and comparative examples. Incidentally, the scope of the present invention may not be limited to the following examples. Herein, "part(s)" and (%) are based on mass if not particularly mentioned.

Test methods used in the examples and the comparative examples are as follows.

EXAMPLE SERIES I

I-1. Production of Sulfonic Acid Group-Containing Copolymer

Production Example I-1

To a 3 L reaction vessel were charged 900 parts of toluene, 83 parts of styrene, 14.5 parts of 2-ethylhexylacrylate, 2.5 parts of 2-acrylamide-2-methylpropanesulfonic acid, and 2.4 parts of 2,2'-azobis(2,4-dimethylvaleronitrile), and a copolymerization reaction was carried out under stirring at 80° C. for 8 hours. After the reaction was completed, the solvent was removed by freeze drying, such that sulfonic acid group-containing copolymer I-1 having a weight average molecular weight of 18,000 and a glass transition temperature of 56.2° C. was obtained. The properties thereof are shown in Table I-1.

Production Examples I-2 to I-6

In Production Example I-1, sulfonic acid group-containing copolymers I-2 to I-6 were each obtained in a similar manner to that of Production Example I-1, except that the use amounts of the monomers used for the copolymerization were changed as shown in the following Table I-1. The properties thereof are shown in Table I-1.

The compositions and measurement results of the sulfonic acid group-containing copolymers I-1 to I-6 are shown in Table I-1. Incidentally, in the following Table I-1, "ST (wt %)" means the addition amount (% by mass) of styrene, "2EHA (wt %)" means the addition amount (% by mass) of 2-ethylhexylacrylate, and "AAMPS (wt %)" means the addition amount (% by mass) of 2-acrylamide-2-methylpropanesulfonic acid, respectively.

TABLE I-1

| | ST (wt %) | 2EHA (wt %) | AAMPS (wt %) | Weight average molecular weight | Glass transition temperature |
|---|---|---|---|---|---|
| Sulfonic acid group-containing copolymer I-1 | 83 | 14.5 | 2.5 | 18000 | 56.2 |
| Sulfonic acid group-containing copolymer I-2 | 85 | 14 | 1 | 18000 | 54.6 |
| Sulfonic acid group-containing copolymer I-3 | 82 | 14.5 | 3.5 | 18000 | 55.9 |
| Sulfonic acid group-containing copolymer I-4 | 80.5 | 14.5 | 5 | 18000 | 56.6 |
| Sulfonic acid group-containing copolymer I-5 | 75 | 15 | 10 | 18000 | 56.9 |
| Sulfonic acid group-containing copolymer I-6 | 85.5 | 14 | 0.5 | 19000 | 55.6 |

I-2. Production of Softening Agent

Production Example I-7

To a reaction vessel equipped with a thermometer, a nitrogen introduction tube, an agitator, a Dean-Stark trap and a Dimroth condenser were added 100 parts of behenyl alcohol and 79.8 parts (a 1.05 molar equivalent amount of the behenyl alcohol) of stearic acid, and a reaction was carried out for 15 hours at an ordinary pressure under a nitrogen airflow at 220° C. while the water generated by the reaction was distilled off, such that an esterified crude product was obtained.

To this esterified crude produce were added 20 parts of toluene and 25 parts of isopropanol, 190 parts of a 10% aqueous potassium hydroxide solution in an amount corresponding to a 1.5-fold equivalent amount of the acid value of the esterified crude product was added, and the resultant was stirred at 70° C. for 30 minutes. The resultant was allowed to stand still for 30 minutes, then the aqueous layer part was removed to complete the deacidification step. Subsequently, 20 parts of ion-exchanged water was put therein, the resultant was stirred at 70° C. for 30 minutes and then allowed to stand still for 30 minutes, and the aqueous layer part was removed. Washing with water was repeated four times until the pH of the removed aqueous layer became neutral. The solvent was distilled off by reducing the pressure of the ester layer under conditions of 180° C. and 1 kPa, and filtration was carried out to give 952.3 g of behenyl stearate, which is the final intended product. The yield with respect to the esterified crude produce subjected to the deacidification treatment was 95.2%.

Production Example I-8

Pentaerythritol tetramyristate was obtained in a similar manner to the above-mentioned Production Example I-7, except that 100 parts of pentaerythritol was used instead of 100 parts of behenyl alcohol, and 704.5 parts (a 4.2 molar equivalent amount of the pentaerythritol) of myristic acid was used instead of 79.8 parts of stearic acid in Production Example I-7.

I-3. Production of Negatively-Chargeable Toner

Example I-1

A polymerizable monomer mixture was obtained by dispersing 75 parts of styrene and 25 parts of n-butyl acrylate as polymerizable monomers and 7 parts of carbon black (manufactured by Mitsubishi Chemical Corporation, product name: #25B) as a black colorant by using a dispersing machine (manufactured by Shinmaru Enterprises Corporation, product name: Dyno-Mill).

To the above-mentioned polymerizable monomer mixture were added 0.8 part of sulfonic acid group-containing copolymer I-1 obtained in the above-mentioned Production Example I-1 as a charge control agent, 20 parts of behenyl stearate as a softening agent, 0.3 part of a polymethacrylic acid ester macromonomer (manufactured by Toagosei Co., Ltd., product name: AA6) as a macromonomer, 0.6 part of divinylbenzene as a crosslinkable polymerizable monomer, and 1.5 parts of t-dodecylmercaptan as a molecular weight modifier, and the resultant was mixed and dissolved, such that a polymerizable monomer composition was prepared.

On the other hand, under room temperature, an aqueous solution in which 6.2 parts of sodium hydroxide had been dissolved in 50 parts of ion-exchanged water was gradually added to an aqueous solution in which 10.2 parts of magnesium chloride had been dissolved in 250 parts of ion-exchanged water under stirring to prepare an aqueous dispersion liquid of a magnesium hydroxide colloid (hardly water-soluble metal hydroxide colloid).

The above-mentioned polymerizable monomer composition was put into the above-mentioned magnesium hydroxide colloid dispersion liquid under room temperature, and stirring was carried out. To the resultant was added 4.4 parts of a polymerization initiator (manufactured by Kayaku Akzo Corporation, product name: Trigonox 27), and high-shear stirring was carried out by using an in-line type emulsification/dispersion machine (manufactured by Pacific Machinery & Engineering Co., Ltd, product name: Cavitron) at a rotation number of 15,000 rpm for 1 minute. By this way, an aqueous dispersion liquid in which the droplets of the polymerizable monomer composition had been dispersed was prepared.

The above-mentioned suspension liquid in which the droplets of the polymerizable monomer composition had been dispersed (polymerizable monomer composition dispersion liquid) was put into a reactor equipped with stirring blades, and a polymerization reaction was initiated by raising the temperature to 90° C. When the polymerization conversion reached approximately 100%, 1 part of methyl methacrylate as a polymerizable monomer for a shell and 0.3 part of 2,2'-azobis(2-methyl-N-(2-hydroxyethyl)-propionamide) as a polymerization initiator for a shell, which had been dissolved in 10 parts of ion-exchanged water, were added, the reaction was continued at 90° C. for 4 hours, and the reaction was then stopped by cooling with water, such that an aqueous dispersion liquid of colored resin particles each having a core-shell structure was obtained.

Sulfuric acid was added dropwise under room temperature while the above-mentioned aqueous dispersion liquid of colored resin particles as stirred, and washing with an acid was carried out until the pH became 6.5 or less. Separation by filtration was then carried out, 500 parts of ion-exchanged water was added to the obtained solid content to form a slurry again, and treatments by water washing (washing, filtration and dehydration) were repeatedly carried out several times. Separation by filtration was then carried out, and the obtained solid content was put into a container of a drier and dried at 40° C. for 24 hours, such that core-shell type colored resin particles having a volume average particle diameter Dv of 7.8 μm and a particle diameter distribution Dv/Dn of 1.11 were obtained.

To 100 parts of the dried colored resin particles were added 1.0 part of a hydrophobized negatively-chargeable silica having an average primary particle diameter of 50 nm (manufactured by Clariant) as an external additive and 0.8 part of a hydrophobized negatively-chargeable silica having an average primary particle diameter of 12 nm (manufactured by Nippon Aerosil Co., Ltd.), and an external addition treatment was carried out by conducting mixing stirring by using a laboratory scale high-speed stirring apparatus with a volume of 10 L having a cooling jacket (manufactured by Nippon Coke & Engineering Co., Ltd., product name: FM mixer) at a circumference velocity of stirring blades of 40 m/sec for an external addition treatment time of 300 seconds, such that the negatively-chargeable toner of Example I-1 was obtained. The results of the evaluation thereof are shown in Table I-2.

Examples I-2 to I-5 and Comparative Examples I-1 to I-8

The negatively-chargeable toners of Examples I-2 to I-5 and Comparative Examples I-1 to I-8 were each obtained in a similar manner to that of Example I-1, except that the charge control agent and softening agent were changed as shown in Table I-2 in Example I-1. The results of the evaluation thereof are shown in Table I-2. Incidentally, in Table I-2, "FT-100" for the softening agent refers to a product name of a natural gas-based Fischer-Tropsch wax (manufactured by D Shell-MS).

I-4. Evaluation of Properties of Colored Resin Particles and Toner

For the above-mentioned negatively-chargeable toners of Examples I-1 to I-5 and Comparative Examples I-1 to I-8, and the colored resin particles used for these negatively-chargeable toners, the properties were investigated. The specifics are as follows.

(1) Measurement of Particle Diameter of Colored Resin Particles

The volume average particle diameter Dv, number average particle diameter Dn and particle diameter distribution Dv/Dn of the colored resin particles were measured by a particle diameter measuring device (manufactured by Beckman Coulter, product name: Multisizer). This measurement by a Multisizer was carried out under conditions of an aperture diameter: 100 μm, dispersion medium: Isoton II (: product name), concentration: 10%, number of measured particles: 100,000 particles.

Specifically, 0.2 g of a sample of colored resin particles was put into a beaker, and an aqueous alkylbenzene sulfonate solution (manufactured by Fujifilm Corporation, product name: DryWell) was added thereto as a dispersant. Furthermore, 2 mL of a dispersion medium was added thereto to allow the colored resin particles to swell, 10 mL of a dispersion medium was added, the mixture was dispersed in an ultrasonic dispersion machine for 1 minute, and the dispersion was measured by the above-mentioned particle diameter measuring device.

(2) Heat-Resistant Shelf Stability

A polyethylene container of 100 mL volume was filled with 20 g of the toner, the container was then tightly-closed by sealing with a lid so that water would not enter, and the container is immersed in water in a thermostat water bath (manufactured by Yamato Scientific Co., Ltd., product name: BK300) preset to a predetermined temperature and then removed after 8 hours had passed. The toner was transferred from the removed container to a 42-mesh sieve (opening: 355 μm) so that oscillation was not applied as possible, and set into a powder body measuring device (manufactured by Hosokawa Micron, product name: Powder Tester PT-X). The amplitude of the sieve was preset to 1.0 mm, the sieve was oscillated for 30 seconds, the mass of the toner remaining on the sieve was then measured and was deemed as a mass of the aggregated toner, and the highest temperature at which the mass of the aggregated toner became 5% or less of the mass of the toner that was firstly put into the container was deemed as a heat-resistant temperature and used as an index of heat-resistant shelf stability.

I-5 Evaluation of Printing with Toner

Printing was evaluated for the negatively-chargeable toners of the above-mentioned Examples I-1 to I-5 and Comparative Examples I-1 to I-8. The details are as follows.

(1) Minimum Fixing Temperature

A fixing test was carried out by using a commercially available printer (20 papers per minute printer) of a non-magnetic one-component development system which had been modified in such a manner that the temperature of a fixing roll can be varied. The fixing test was carried out by printing a black solid-printed area (print density: 100%) and varying the temperature of the fixing roll in steps of 5° C. in the modified printer to measure the fixing rate of the toner at each temperature, thereby finding a relationship between the temperature and the fixing rate. The fixing rate was calculated from the ratio of image densities before and after a peeling operation using a tape, which was carried out against a black solid-printed area (print density: 100%) of a test paper sheet, on which printing had been made by the modified printer. Specifically, assuming that the image density before the peeling of the tape is ID (before), and the image density after the peeling of the tape is ID (after), the fixing rate can be calculated out from the following Calculation Formula 1.

$$(\text{Fixing rate } (\%)=(\text{ID(after)}/\text{ID(before)})\times 100 \qquad \text{(Calculation Formula 1)}$$

The peeling operation of the tape is a series of operation that a adhesive tape (product name: Scotch Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer (manufactured by McBeth Co., product name: RD914). In this fixing test, the lowest temperature of the fixing roll at which a fixing rate of the toner was more than 80% was defined as the minimum fixing temperature of the toner.

(2) Thin-Line Reproducibility

For testing the thin-line reproducibility, using the same printer as that mentioned above, the toner cartridge of the developing apparatus was filled with the toner, and printing paper sheets were set.

The developing apparatus was left under an environment of a normal-temperature and a normal-humidity (N/N) (temperature: 23° C., humidity: 50%) for 24 hours, and a line image was continuously formed at 2×2 dot line (width: about 85 μm) under the same environment, and the continuous printing was carried out on 10,000 sheets.

The density distribution data of the line images was collected from every 500 sheets by using a printing evaluation system (manufactured by YA-MA, product name: RT2000).

From the collected density distribution data of the line images, assuming that the whole width of the line of the line image at a half value of the maximum value of the density is a line width, the number of sheets on which continuous print had been carried out at which the difference of the line widths can be maintained to be 10 μm or less based on the line width formed on the firstly collected print paper was investigated.

(3) Fog Test

Printing paper sheets were set in a commercially available printer (28 papers per minute printer) of a non-magnetic one-component development system, the toner was put into a developing apparatus, and the developing apparatus was left under an environment of a high temperature and a high humidity (H/H) of 35° C. and a humidity of 80% RH for 24 hours and an environment of a low temperature and a low humidity (L/L) of a temperature 10° C./a relative humidity of 20% for 24 hours, respectively, and continuous printing was carried out on three sheets under the same environment at a printing density of 5%.

Thereafter, white solid printing was carried out, the printing was stopped in midstream, and the toner on a non-image part on the photosensitive member after the developing was peeled off by means of a adhesive tape and then attached to a new printing paper sheet. The color tones thereof were measured by using the above-mentioned reflection image densitometer and respectively represented as coordinates on the Lab space, and a color difference ΔE was calculated and deemed as a fog value. A smaller value of this fog value indicates smaller fog.

The results of the measurements and evaluations of the negatively-chargeable toners of Examples I-1 to I-5 and Comparative Examples I-1 to I-8 are shown in Table I-2. Incidentally, in the following Table I-2, "copolymerization ratio (wt %)" means each copolymerization ratio (% by mass) of 2-acrylamide-2-methylpropanesulfonic acid in the sulfonic acid group-containing copolymers I-1 to I-6. Furthermore, in the following Table I-2, "HH" in "fog" means a fog value under a high temperature-high humidity (H/H) environment in the above-mentioned fog test, and "LL" in "fog" means a fog value under a low temperature-low humidity (L/L) environment in the above-mentioned fog test.

TABLE 2

| | | Example I-1 | Example I-2 | Example I-3 | Example I-4 | Example I-5 |
|---|---|---|---|---|---|---|
| Sulfonic acid group-containing copolymer | | Copolymer I-1 | Copolymer I-2 | Copolymer I-3 | Copolymer I-1 | Copolymer I-1 |
| Copolymerization rate (wt %) | | 2.5 | 1 | 3.5 | 2.5 | 2.5 |
| Softening agent | Behenyl stearate (parts) | 20 | 20 | 20 | 14 | — |
| | Behenyl behenate (parts) | — | — | — | — | 20 |
| | Pentaerythritol tetramyristate (parts) | — | — | — | — | — |
| | FT-100 (parts) | — | — | — | — | — |
| Volume average particle diameter Dv (μm) | | 7.8 | 7.4 | 7.3 | 7.2 | 7.5 |
| Dv/Dn | | 1.11 | 1.12 | 1.15 | 1.12 | 1.13 |
| Heat resistant temperature (° C.) | | 56 | 56 | 56 | 56 | 56 |
| Minimum fixing temperature (° C.) | | 130 | 130 | 130 | 135 | 135 |
| Thin-line reproducibility (number of sheets) | | 10000 | 10000 | 9000 | 10000 | 10000 |
| Fog | HH | 0.8 | 1.2 | 1.1 | 0.6 | 0.8 |
| | LL | 0.3 | 0.4 | 0.6 | 0.3 | 0.4 |

| | | Comparative Example I-1 | Comparative Example I-2 | Comparative Example I-3 | Comparative Example I-4 |
|---|---|---|---|---|---|
| Sulfonic acid group-containing copolymer | | Copolymer I-1 | Copolymer I-1 | Copolymer I-2 | Copolymer I-3 |
| Copolymerization rate (wt %) | | 2.5 | 2.5 | 1 | 3.5 |
| Softening agent | Behenyl stearate (parts) | — | — | — | — |
| | Behenyl behenate (parts) | — | — | — | — |
| | Pentaerythritol tetramyristate (parts) | 10 | — | 10 | 10 |
| | FT-100 (parts) | — | 2 | — | — |
| Volume average particle diameter Dv (μm) | | 7.6 | 7.7 | 7.6 | 7.5 |
| Dv/Dn | | 1.16 | 1.20 | 1.17 | 1.23 |
| Heat resistant temperature (° C.) | | 55 | 55 | 55 | 55 |
| Minimum fixing temperature (° C.) | | 145 | 150 | 145 | 145 |
| Thin-line reproducibility (number of sheets) | | 8000 | 7000 | 8500 | 6000 |
| Fog | HH | 1.7 | 2.1 | 1.5 | 1.8 |
| | LL | 1.1 | 1.2 | 0.8 | 1.0 |

TABLE 2-continued

| | | Comparative Example I-5 | Comparative Example I-6 | Comparative Example I-7 | Comparative Example I-8 |
|---|---|---|---|---|---|
| Sulfonic acid group-containing copolymer | | Copolymer I-4 | Copolymer I-5 | Copolymer I-5 | Copolymer I-6 |
| Copolymerization rate (wt %) | | 5 | 10 | 10 | 0.5 |
| Softening agent | Behenyl stearate (parts) | — | — | 20 | 20 |
| | Behenyl behenate (parts) | — | — | — | — |
| | Pentaerythritol tetramyristate (parts) | 10 | 10 | — | — |
| | FT-100 (parts) | — | — | — | — |
| Volume average particle diameter Dv (μm) | | 7.7 | 8.0 | 7.6 | 7.3 |
| | Dv/Dn | 1.24 | 1.34 | 1.22 | 1.12 |
| Heat resistant temperature (° C.) | | 54 | 54 | 55 | 56 |
| Minimum fixing temperature (° C.) | | 145 | 150 | 120 | 130 |
| Thin-line reproducibility (number of sheets) | | 6000 | 4000 | 7000 | 8000 |
| Fog | HH | 1.9 | 3.1 | 1.7 | 5.5 |
| | LL | 1.0 | 1.3 | 0.9 | 0.2 |

I-6. Summary of Evaluation of Toners

The evaluation of the toners will be considered below with referring to Tables I-1 and I-2.

Firstly, the toners of Comparative Examples I-1, I-3 and I-4 will be considered. From Table I-2, these toners are toners each containing 10 parts of pentaerythritol tetramyristate as a softening agent.

From Table I-2, in the toners of Comparative Examples I-1, I-3 and I-4, the heat-resistant temperature was low as 55° C. in either toner, the minimum fixing temperature was high as 145° C. in either toner, the number of the sheets for which the thin-line reproducibility was evaluated was small as 8,500 sheets or less, the value of HH fog was high as 1.5 or more, and the value of LL fog was high as 0.8 or more.

It is understood from above that the toners of Comparative Examples I-1, I-3 and I-4, which contains a tetraester compound instead of a monoester compound as a softening agent are poor in heat-resistant shelf stability and low-temperature fixability, poor in thin-line reproducibility, and easily cause fog.

Secondly, the toner of Comparative Example I-2 will be considered. From Table I-2, the toner of Comparative Example I-2 is a toner containing 2 parts of FT-100 as a softening agent.

From Table I-2, in the toner of Comparative Example I-2, the heat-resistant temperature is low as 55° C., the minimum fixing temperature is high as 150° C., the number of the sheets for which the thin-line reproducibility was evaluated is small as 7,000, the value of HH fog is high as 2.1, and the value of LL fog is high as 1.2. Specifically, the minimum fixing temperature is the highest among the toners measured at this time.

It is understood from above that the toner of Comparative Example I-2, which contains a Fischer-Tropsch wax instead of a monoester compound as a toner softening agent, is specifically poor in low-temperature fixability, poor in heat-resistant shelf stability and thin-line reproducibility, and easily causes fog.

Subsequently, the toners of Comparative Examples I-5 to I-7 will be considered. From Table I-2, the toners of Comparative Examples I-5 and I-6 are toners each containing 10 parts of pentaerythritol tetramyristate as a softening agent and containing sulfonic acid group-containing copolymer I-4 or I-5 having a copolymerization ratio of 2-acrylamide-2-methylpropanesulfonic acid of 5% by mass or more. Furthermore, from Table I-2, the toner of Comparative Example I-7 is a toner containing sulfonic acid group-containing copolymer I-5 having a copolymerization ratio of 2-acrylamide-2-methylpropanesulfonic acid of 10% by mass.

From Table I-2, the Dv/Dn of the toners of Comparative Examples I-5 to I-7 is large as 1.22 or more. This is due to that the above-mentioned copolymerization ratio exceeds 4.0% by mass, and thus a toner having homogeneous particle diameters is difficult to be obtained.

Accordingly, nonhomogeneous particle diameters of the toner adversely affect, in particular, the heat-resistant shelf stability and chargeability. From Table I-2, in the toners of Comparative Examples I-5 to I-7, the heat-resistant temperature is low as 55° C. or less, the number of the sheets for which the thin-line reproducibility was evaluated is small as 7,000 sheets or less, the value of HH fog is high as 1.7 or more, and the value of LL fog is high as 0.9 or more.

It is understood from the above that the toners of Comparative Examples I-5 to I-7, each contains a sulfonic acid group-containing copolymer having a copolymerization ratio of 2-acrylamide-2-methylpropanesulfonic acid of more than 4.0% by mass as a charge control agent, are poor in chargeability since homogeneous particle diameters are difficult to be obtained, and consequently, the toners are poor in heat-resistant shelf stability and thin-line reproducibility and easily cause fog.

Furthermore, from Table I-2, the minimum fixing temperature is high as 145° C. or more in the toners of Comparative Examples I-5 and I-6.

Accordingly, it is understood that the toners of Comparative Examples I-5 and I-6, which contain a tetraester compound as a softening agent instead of the monoester compound, are also poor in low-temperature fixability.

Subsequently, the toner of Comparative Example I-8 will be considered. From Table I-2, the toner of Comparative Example I-8 is a toner containing sulfonic acid group-containing copolymer I-6 having a copolymerization ratio of 2-acrylamide-2-methylpropanesulfonic acid of 0.5% by mass.

From Table I-2, the toner of Comparative Example I-8 has a heat-resistant temperature of 56° C., a minimum fixing temperature of 130° C., and a value of LL fog of 0.2. Therefore, in the toner of Comparative Example I-8, no problem is seen in at least heat-resistant shelf stability, low-temperature fixability and fog under low-temperature/low-humidity (L/L) conditions. However, in the toner of Comparative Example I-8, the number of the sheets for which the thin-line reproducibility was evaluated is low as 8,000 sheets, and the value of HH fog is high as 5.5. Specifically, the value of HH fog in Comparative Example I-8 is the highest among the toners that were measured at this time.

It is understood from the above that the toner of Comparative Example I-8, which contains a sulfonic acid group-containing copolymer having a copolymerization ratio of 2-acrylamide-2-methylpropanesulfonic acid of lower than 0.8% by mass as a charge control agent, is poor in thin-line reproducibility and easily causes fog.

On the other hand, from Table I-2, the toners of Examples I-1 to I-5 are toners each containing any one of sulfonic acid group-containing copolymers I-1 to I-3 having a copolymerization ratio of 2-acrylamide-2-methylpropanesulfonic acid of 1 to 3.5% by mass and 14 to 20 parts of behenyl stearate or 20 parts of behenyl behenate.

From Table I-2, in the toners of Examples I-1 to I-5, Dv/Dn is small as 1.15 or less, the heat-resistant temperature is high as 56° C. in either case, the minimum fixing temperature is 135° C. or less, the number of the sheets for which the thin-line reproducibility was evaluated is 9,000 sheets or more, the value of HH fog is low as 1.2 or less, and the value of LL fog is low as 0.6 or less.

Accordingly, it is understood that the toners of Examples I-1 to I-5, each of which contains a sulfonic acid group-containing copolymer having a copolymerization ratio of 2-acrylamide-2-methylpropanesulfonic acid of 0.8 to 4.0% by mass, and contains a monoester compound as a softening agent, are toners that are excellent in balance between low-temperature fixability and heat-resistant shelf stability, have fine thin-line reproducibility, and generate little fog, even in high-speed printing.

Example Series II

II-1. Production of Sulfonic Acid Group-Containing Copolymer

Production Examples II-1 to II-6

Sulfonic acid group-containing copolymers II-1 to II-6 were prepared in similar manners to those for sulfonic acid group-containing copolymers I-1 to I-6 in the above-mentioned Example Series I. The compositions and physical properties of the sulfonic acid group-containing copolymers II-1 to II-6 respectively correspond to the compositions and physical properties of sulfonic acid group-containing copolymers I-1 to I-6 in the above-mentioned Table I-1.

II-2. Production of Softening Agent

Production Example II-7

To a reaction vessel equipped with a thermometer, a nitrogen introduction tube, an agitator, a Dean-Stark trap and a Dimroth condenser were added 100 parts of hexaglycerol and 605 parts (a 8.2 molar equivalent amount of the hexaglycerol) of behenic acid, and a reaction was carried out under a nitrogen airflow at 220° C. for 15 hours at an ordinary pressure while the water generated by the reaction was distilled off, such that an esterified crude product was obtained.

To this esterified crude product were added 20 parts of toluene and 25 parts of isopropanol, and 190 parts of a 10% aqueous potassium hydroxide solution in an amount corresponding to a 1.5-fold equivalent amount of the acid value of the esterified crude product was added, and the resultant was stirred at 70° C. for 30 minutes. The resultant was allowed to stand still for 30 minute, and the aqueous layer part was removed to complete the deacidification step. Then, 20 parts of ion-exchanged water was put into the resultant, the resultant was stirred at 70° C. for 30 minutes and allowed to stand still for 30 minutes, and the aqueous layer part was then removed. Washing with water was repeated four times until the pH of the removed aqueous layer became neutral. The ester layer was subjected to a reduced pressure under conditions of 180° C. and 1 kPa to distill the solvent off, and filtration was carried out, such that hexaglycerol octabehenate, which is a final intended product, was obtained.

Production Example II-8

Pentaerythritol tetramyristate was obtained in a similar manner to the above-mentioned Production Example II-7, except that 100 parts of pentaerythritol was used instead of 100 parts of hexaglycerol and 704.5 parts (a 4.2 molar equivalent amount of the pentaerythritol) of myristic acid was used instead of 605 parts of behenic acid in Production Example II-7.

II-3. Production of Negatively-Chargeable Toner

Example II-1

A polymerizable monomer mixture was obtained by dispersing 75 parts of styrene and 25 parts of n-butylacrylate as polymerizable monomers, and 7 parts of carbon black (manufactured by Mitsubishi Chemical Corporation, product name: #25B) as a black colorant by using a dispersing machine (manufactured by Shinmaru Enterprises Corporation, product name: Dyno-Mill).

To the above-mentioned polymerizable monomer mixture were added 0.8 part of sulfonic acid group-containing copolymer II-1 obtained in the above-mentioned Production Example II-1 as a charge control agent, 5 parts of the hexaglycerol octabehenate synthesized in the above-mentioned Production Example II-7 and 5 parts of a paraffin wax having a melting point of 68° C. (manufactured by Nippon Seiro Co., Ltd., product name: HNP-11) as softening agents, 0.3 part of a polymethacrylic acid ester macromonomer (manufactured by Toagosei Co., Ltd., product name: AA6) as a macromonomer, 0.6 part of divinylbenzene as a cross-linkable polymerizable monomer, and 1 part of tetraethylthiuram disulfide as a molecular weight modifier, and the resultant was mixed and dissolved, such that a polymerizable monomer composition was prepared.

On the other hand, under room temperature, an aqueous solution in which 6.2 parts of sodium hydroxide had been dissolved in 50 parts of ion-exchanged water was gradually added to an aqueous solution in which 10.2 parts of magnesium chloride had been dissolved in 250 parts of ion-exchanged water under stirring, such that an aqueous dispersion liquid of a magnesium hydroxide colloid (a hardly water-soluble metal hydroxide colloid) was prepared.

The above-mentioned polymerizable monomer composition was put into the above-mentioned magnesium hydroxide colloid dispersion liquid under room temperature, and stirring was carried out. To the resultant was added 4.4 parts of a polymerization initiator (manufactured by Kayaku Akzo corporation, product name: Trigonox 27), and high-shear stirring was carried out by using an in-line type emulsification/dispersion machine (manufactured by Pacific Machinery & Engineering Co., Ltd, product name: Cavitron) at a rotation number of 15,000 rpm for 1 minute, such that fine droplets of the polymerizable monomer composition were formed in the aqueous dispersion medium. By this way, an aqueous dispersion liquid in which the droplets of the polymerizable monomer composition had been dispersed was prepared.

The above-mentioned suspension liquid in which the droplets of the polymerizable monomer composition had been dispersed (polymerizable monomer composition dispersion liquid) was put into a reactor equipped with stirring blades, and a polymerization reaction was initiated by raising the temperature to 90° C. When the polymerization conversion reached about 100%, 1 part of methyl methacrylate as a polymerizable monomer for a shell, and 0.3 part of 2,2'-azobis(2-methyl-N-(2-hydroxyethyl)propionamide) as a polymerization initiator for a shell dissolved in 10 parts of ion-exchanged water, were added, the reaction was continued at 90° C. for 4 hours, and the reaction was then stopped by cooling with water, such that an aqueous dispersion liquid of colored resin particles each having a core-shell structure was obtained.

Sulfuric acid was added dropwise under room temperature while the above-mentioned aqueous dispersion liquid of colored resin particles was stirred, and washing with an acid was carried out until the pH became 6.5 or less. Separation by filtration was then carried out, 500 parts of ion-exchanged water was added to the obtained solid content to form a slurry again, and treatments by water washing (washing, filtration and dehydration) were repeatedly carried out several times. Separation by filtration was then carried out, and the obtained solid content was put into a container of a drier and dried at 40° C. for 24 hours, such that core-shell type colored resin particles having a volume average particle diameter Dv of 7.8 μm and a particle diameter distribution Dv/Dn of 1.13 were obtained.

To 100 parts of the dried colored resin particles were added 1.0 part of a hydrophobized negatively-chargeable silica having an average primary particle diameter of 50 nm (manufactured by Clariant) and 0.8 part of a hydrophobized negatively-chargeable silica having an average primary particle diameter of 12 nm (manufactured by Nippon Aerosil Co., Ltd.) as an external additive, and an external addition treatment was carried out by conducting mixing stirring by using a laboratory scale high-speed stirring apparatus with a volume of 10 L having a cooling jacket (manufactured by Nippon Coke & Engineering Co., Ltd., product name: FM mixer) at a circumference velocity of stirring blades of 40 m/sec for an external addition treatment time of 300 seconds, such that the negatively-chargeable toner of Example II-1 was obtained. The results of the evaluation thereof are shown in Table II-1.

Examples II-2 to II-5 and Comparative Examples II-1 to II-8

The negatively-chargeable toners of Examples II-2 to II-5 and Comparative Examples II-1 to II-8 were each obtained in a similar manner to that of Example II-1, except that the negative-charging controlling resin and softening agent were changed as shown in Table II-1 in Example II-1. The results of the evaluation thereof are shown in Table II-1.

II-4. Evaluation of Properties of Colored Resin Particles and Toners

For the negatively-chargeable toners of the above-mentioned Examples II-1 to II-5 and Comparative Examples II-1 to II-8, the heat-resistant temperature of the toner was measured in a similar method to that in "(2) Heat-resistant shelf stability" in the above-mentioned Example Series I. Furthermore, for the colored resin particles used in these negatively-chargeable toners, the particle diameters of the colored resin particles were measured in a similar method to that in "(1) Measurement of particle diameters of colored resin particles" in the above-mentioned Example Series I.

II-5. Evaluation of Printing of Toner

For the negatively-chargeable toners of the above-mentioned Examples II-1 to II-5 and Comparative Examples II-1 to II-8, the printing was evaluated in similar methods to those in "(1) Minimum fixing temperature", "(2) Thin-Line Reproducibility" and "(3) Fog Test" in the above-mentioned Example Series I. Incidentally, as to the thin-line reproducibility, "10000<" in the test result in Table II-1 indicates that the difference in line widths can be maintained at 10 μm or less even printing is continuously carried out on 10,000 sheets.

Furthermore, for these negatively-chargeable toners, the durability after leaving at a high temperature was evaluated as follows.

(4) Durability after Leaving at High Temperature

The negatively-chargeable toner was put into a sealable container under an ordinary temperature-ordinary humidity (N/N) environment (N/N) at a temperature of 23° C. and a humidity of 50%. This container was stored under an environment at a temperature of 50° C. for 5 days, opened, and then returned to an ordinary temperature-ordinary humidity (N/N) environment (N/N) at a temperature of 23° C. and a humidity of 50%. The negatively-chargeable toner was removed from the container, and using this negatively-chargeable toner, a fog value was calculated in a similar manner to that explained in the item of "(3) Fog Test" in the above-mentioned Example Series I. The number of sheets for continuous printing for which the fog value can maintain an image quality of 1 or less was investigated. Incidentally, "10000<" in the test result of Table II-1 indicates that the fog value can maintain an image quality of 1 or less even printing is continuously carried out on 10,000 sheets.

The results of the measurements and evaluations of the negatively-chargeable toners of Examples II-1 to II-5 and Comparative Examples II-1 to II-8 are shown in Table II-1. Incidentally, in the following Table II-1, "copolymerization ratio (wt %)" means each copolymerization ratio (% by mass) of 2-acrylamide-2-methylpropanesulfonic acid in sulfonic acid group-containing copolymers II-1 to II-6. Furthermore, in the following Table II-1, "HH" in "fog" means a fog value under a high temperature-high humidity (H/H) environment in the above-mentioned fog test, and "LL" in "fog" means a fog value under a low temperature-low humidity (L/L) environment in the above-mentioned fog test.

TABLE 3

| | | Example II-1 | Example II-2 | Example II-3 | Example II-4 | Example II-5 |
|---|---|---|---|---|---|---|
| Sulfonic acid group-containing copolymer | | Copolymer II-1 | Copolymer II-2 | Copolymer II-3 | Copolymer II-1 | Copolymer II-1 |
| Copolymerization rate (wt %) | | 2.5 | 1 | 3.5 | 2.5 | 2.5 |
| Softening agent | Hexaglycerol octabehenate (parts) | 5 | 5 | 5 | 5 | 10 |

TABLE 3-continued

| | | | | | |
|---|---|---|---|---|---|
| Pentaerythritol tetramyristate (parts) | — | — | — | — | — |
| Paraffin wax (parts) | 5 | 5 | 5 | — | — |
| Volume average particle diameter Dv (μm) | 6.8 | 6.9 | 7.1 | 6.6 | 6.9 |
| Dv/Dn | 1.13 | 1.12 | 1.15 | 1.13 | 1.12 |
| Heat resistant temperature (° C.) | 56 | 56 | 56 | 57 | 55 |
| Minimum fixing temperature (° C.) | 140 | 140 | 140 | 145 | 140 |
| Thin-line reproducibility (number of sheets) | 10000< | 10000< | 9000 | 8000 | 7000 |
| Fog HH | 0.8 | 0.8 | 1.1 | 0.8 | 1.2 |
| LL | 0.4 | 0.6 | 0.5 | 0.4 | 0.5 |
| Durability after leaving at high temperature (number of sheets) | 10000< | 10000< | 10000< | 10000< | 8500 |

| | Comparative Example II-1 | Comparative Example II-2 | Comparative Example II-3 | Comparative Example II-4 |
|---|---|---|---|---|
| Sulfonic acid group-containing copolymer | Copolymer II-1 | Copolymer II-1 | Copolymer II-2 | Copolymer II-3 |
| Copolymerization rate (wt %) | 2.5 | 2.5 | 1 | 3.5 |
| Softening agent Hexaglycerol octabehenate (parts) | — | — | — | — |
| Pentaerythritol tetramyristate (parts) | 10 | — | 10 | 10 |
| Paraffin wax (parts) | — | 2 | — | — |
| Volume average particle diameter Dv (μm) | 7.2 | 6.5 | 7.3 | 7.4 |
| Dv/Dn | 1.18 | 1.20 | 1.17 | 1.23 |
| Heat resistant temperature (° C.) | 55 | 55 | 55 | 55 |
| Minimum fixing temperature (° C.) | 145 | 150 | 145 | 145 |
| Thin-line reproducibility (number of sheets) | 8500 | 6000 | 6000 | 4000 |
| Fog HH | 1.7 | 2.1 | 1.5 | 1.8 |
| LL | 1.1 | 1.2 | 0.8 | 1.0 |
| Durability after leaving at high temperature (number of sheets) | 6000 | 7000 | 8500 | 6000 |

| | Comparative Example II-5 | Comparative Example II-6 | Comparative Example II-7 | Comparative Example II-8 |
|---|---|---|---|---|
| Sulfonic acid group-containing copolymer | Copolymer II-4 | Copolymer II-5 | Copolymer II-5 | Copolymer II-6 |
| Copolymerization rate (wt %) | 5 | 10 | 10 | 05 |
| Softening agent Hexaglycerol octabehenate (parts) | — | — | 6 | 5 |
| Pentaerythritol tetramyristate (parts) | 10 | 10 | — | — |
| Paraffin wax (parts) | — | — | — | — |
| Volume average particle diameter Dv (μm) | 7 | 7.1 | 6.6 | 6.9 |
| Dv/Dn | 1.24 | 1.34 | 1.22 | 1.12 |
| Heat resistant temperature (° C.) | 54 | 54 | 55 | 56 |
| Minimum fixing temperature (° C.) | 145 | 150 | 120 | 130 |
| Thin-line reproducibility (number of sheets) | 7000 | 9500 | 7000 | 9000 |
| Fog HH | 1.8 | 3.1 | 1.7 | 5.5 |
| LL | 1.0 | 1.3 | 0.9 | 0.2 |
| Durability after leaving at high temperature (number of sheets) | 6000 | 4000 | 7000 | 9500 |

II-6. Summary of Evaluation of Toners

The evaluation of the toners will be considered below with mainly referring to Tables II-1.

Firstly, the toners of Comparative Examples II-1, II-3 and II-4 will be considered. From Table II-1, these toners are toners each containing 10 parts of pentaerythritol tetramyristate as a softening agent.

From Table II-1, in the toners of Comparative Examples II-1, II-3 and II-4, the value of HH fog is high as 1.5 or more, and the value of LL fog is high as 0.8 or more.

It is understood from the above that the toners of Comparative Examples II-1, II-3 and II-4, which contain an erythritol ester compound as a softening agent instead of the polyglycerol ester compound, easily cause fog under either temperature and humidity environment.

Secondly, the toner of Comparative Example II-2 will be considered. From Table II-1, the toner of Comparative Example II-2 is a toner containing only a paraffin wax (manufactured by Nippon Seiro Co., Ltd., product name: HNP-11) as a softening agent.

From Table II-1, in the toner of Comparative Example II-2, the minimum fixing temperature is high as 105° C., the number of the sheets for which the thin-line reproducibility was evaluated is small as 6,000 sheets, the value of HH fog is high as 2.1, the value of LL fog is high as 1.2, and the number of the sheets for which the durability after leaving at a high temperature was evaluated is small as 7,000 sheets. Specifically, the minimum fixing temperature was the highest among the toners measured at this time.

It is understood from the above that the toner of Comparative Example II-2, which contains only a paraffin wax as a softening agent, is specifically poor in low-temperature fixability, is poor in heat-resistant shelf stability, thin-line reproducibility and durability after leaving at a high temperature, and easily causes fog.

Subsequently, the toners of Comparative Examples II-5 to II-7 will be considered. From Table II-1, the toners of Comparative Examples II-5 and II-6 are toners each containing 10 parts of pentaerythritol tetramyristate as a softening agent, and containing sulfonic acid group-containing copolymer II-4 or II-5 having a copolymerization ratio of 2-acrylamide-2-methylpropanesulfonic acid of 5% by mass or more. Furthermore, from Table II-1, the toner of Comparative Example II-7 is a toner containing sulfonic acid group-containing copolymer II-5 having a copolymerization ratio of 2-acrylamide-2-methylpropanesulfonic acid of 10% by mass.

From Table II-1, the Dv/Dn of the toners of Comparative Examples II-5 to II-7 is large as 1.22 or more. This is due to that the above-mentioned copolymerization ratio is more than 4.0% by mass, and thus a toner having homogeneous particle diameters is difficult to be obtained.

Therefore, the homogeneous particle diameters of the toner adversely affect, in particular the chargeability and the durability after leaving at a high temperature. From Table II-1, in the toners of Comparative Examples II-5 to II-7, the value of HH fog is high as 1.7 or more, the value of LL fog is high as 0.9 or more, and the number of the sheets for which the durability after leaving at a high temperature was evaluated is small as 7,000 sheets or less.

It is understood from the above that the toners of Comparative Examples II-5 to II-7, each containing a sulfonic acid group-containing copolymer having a copolymerization ratio of 2-acrylamide-2-methylpropanesulfonic acid of more than 4.0% by mass as a charge control agent, are poor in chargeability since homogeneous particle diameters are difficult to be obtained, and consequently, the toners are poor in durability after leaving at a high temperature, and easily cause fog.

Furthermore, from Table II-1, in the toners of Comparative Examples II-5 and II-6, the heat-resistant temperature is low as 54° C.

Therefore, the toners of Comparative Examples II-5 and II-6, which contain an erythritol ester compound instead of a polyglycerol ester compound as a softening agent, are also poor in heat-resistant shelf stability.

Subsequently, the toner of Comparative Example II-8 will be considered. From Table II-1, the toner of Comparative Example II-8 is a toner containing sulfonic acid group-containing copolymer II-6, which has a copolymerization of 2-acrylamide-2-methylpropanesulfonic acid of 0.5% by mass.

From Table II-1, in the toner of Comparative Example II-8, the heat-resistant temperature is 56° C., the minimum fixing temperature is 130° C., the number of the sheets for which the thin-line reproducibility was evaluated is 9,000 sheets, the value of LL fog is 0.2, and the number of the sheets for which durability after leaving at a high temperature was evaluated is 9,500 sheets. Accordingly, in the toner of Comparative Example II-8, no problem is observed in at least the heat-resistant shelf stability, the low-temperature fixability, the thin-line reproducibility, the fog under a low temperature-low humidity (L/L) condition, and the durability after leaving at a high temperature. However, the value of HH fog is high as 5.5 in the toner of Comparative Example II-8. This value of HH fog is the highest among the toners measured at this time.

From the above, it is understood that the toner of Comparative Example II-8, which contains a sulfonic cid group-containing copolymer having a copolymerization ratio of 2-acrylamide-2-methylpropanesulfonic acid of lower than 0.8% by mass as a charge control agent, easily causes fog specifically under a high temperature-high humidity environment.

On the other hand, from Table II-1, the toners of Examples II-1 to II-5 are toners each containing any one of sulfonic acid group-containing copolymers II-1 to II-3, each having a copolymerization ratio of 2-acrylamide-2-methylpropanesulfonic acid of 1 to 3.5% by mass, and containing hexaglycerol octabehenate.

From Table II-1, in the toners of Examples II-1 to II-5, Dv/Dn is small as 1.15 or less, the heat-resistant temperature is high as 55° C. or more in either case, the minimum fixing temperature is low as 145° C. or less, the number of the sheets for which the thin-line reproducibility was evaluated is many as 7,000 sheets or more, the value of HH fog is low as 1.2 or less, the value of LL fog is low as 0.6 or less, and the number the sheets for which the durability after leaving at a high temperature was evaluated is many as 8,500 sheets or more.

Accordingly, the toners of Examples II-1 to II-5, each of which contains a sulfonic acid group-containing copolymer having a copolymerization ratio of 2-acrylamide-2-methylpropanesulfonic acid of 0.8 to 4.0% by mass and contains a polyglycerol ester compound as a softening agent, are toners that are excellent in balance between low-temperature fixability and heat-resistant shelf stability, have fine thin-line reproducibility, generate little fog, and are excellent in durability, even in high-speed printing.

The toners of Examples II-1 to II-3 are toners further containing a paraffin wax (manufactured by Nippon Seiro Co., Ltd., product name: HNP-11) as a softening agent.

From Table II-1, in the toners of Examples II-1 to II-3, the heat-resistant temperature is higher as 56° C. or more in either case, the minimum fixing temperature is lower as 140° C. or less, the number of the sheets for which the thin-line reproducibility was evaluated is larger as 9,000 sheets or more, the value of HH fog is lower as 1.1 or less, and the number of the sheets for which the durability after leaving at a high temperature was evaluated is more than 10,000 sheets in either case.

Accordingly, it is understood that the toners of Examples II-1 to II-3, each contains a sulfonic acid group-containing copolymer having a copolymerization ratio of 2-acrylamide-2-methylpropanesulfonic acid of 0.8 to 4.0% by mass and further contains a polyglycerol ester compound and a paraffin wax as softening agents, are toners that are further excellent in heat-resistant shelf stability, low-temperature fixability, thin-line reproducibility, and chargeability and durability under a high temperature-high humidity (H/H) environment.

Example III-1

The negatively-chargeable toner of Example III-1 was obtained in a similar manner to Example II-4, except that 14 parts of behenyl stearate was further added as a softening agent in Example II-4. When the colored resin particles and negatively-chargeable toner were evaluated in similar manners to those of Example II-4, evaluation results that were higher as a whole than those in Example II-4 were obtained. The results are shown in Table III-1. Specifically, the minimum fixing temperature in Example III-1 is 15° C. lower than the minimum fixing temperature in Example II-4. Furthermore, the number of the sheets for which the thin-line reproducibility was evaluated in Example III-1 is 2,000 sheets or more larger than the number of the sheets for which the thin-line reproducibility was evaluated in Example II-4. It is understood from the above-mentioned results that the low-temperature fixability and thin-line reproducibility of the negatively-chargeable toner of Example III-1 are further more excellent than those of Example II-4.

TABLE III-1

| | | Example III-1 |
|---|---|---|
| Sulfonic acid group-containing copolymer | | Copolymer II-1 |
| Copolymerization rate (wt %) | | 2.5 |
| Softening agent | Hexaglycerol octatehenate (parts) | 5 |
| | Behenyl stearate (parts) | 14 |
| | Paraffin wax (parts) | — |
| Volume average particle diameter Dv(μm) | | 7.3 |
| Dv/Dn | | 1.11 |
| Heat resistant temperature (° C.) | | 56 |
| Minimum fixing temperature (° C.) | | 130 |
| Thin-line reproducibility (number of sheets) | | 10000< |
| Fog | HH | 0.7 |
| | LL | 0.5 |
| Durability after leaving at high temperature (number of sheets) | | 10000< |

The invention claimed is:

1. A negatively-chargeable toner comprising colored resin particles which contain at least a binder resin, a colorant, a charge control agent and a softening agent, wherein the charge control agent is a copolymer which is obtained by copolymerizing a vinyl aromatic hydrocarbon, a (meth)acrylate and a sulfonic acid group-containing (meth)acrylamide and in which a copolymerization ratio of the sulfonic acid group-containing (meth)acrylamide in the copolymer is 0.8 to 4.0% by mass, and a weight average molecular weight of the charge control agent is 5,000 to 25,000, and wherein the softening agent is at least one of a monoester compound and a polyglycerol ester compound.

2. The negatively-chargeable toner according to claim 1, wherein the colorant is carbon black.

3. The negatively-chargeable toner according to claim 1, wherein an amount of the softening agent is 1 to 25 parts by mass with respect to 100 parts by mass of the binder resin.

4. The negatively-chargeable toner according to claim 1, wherein an amount of the charge control agent is 0.1 to 8 parts by mass with respect to 100 parts by mass of the binder resin.

5. The negatively-chargeable toner according to claim 1, wherein the toner is obtained by a suspension polymerization method.

6. The negatively-chargeable toner according to claim 1, wherein the negatively-chargeable toner has a core-shell structure.

7. A method for producing a negatively-chargeable toner, the method comprising:

a suspension step in which, by suspending a polymerizable monomer composition which contains at least a polymerizable monomer, a colorant, a charge control agent and a softening agent in an aqueous dispersion medium which contains a dispersion stabilizer, a suspension in which droplets of the polymerizable monomer composition are dispersed is obtained, and a step of obtaining colored resin particles by carrying out suspension polymerization of the droplets of the polymerizable monomer composition in the suspension in the presence of a polymerization initiator, wherein, in the suspension step, a copolymer which is obtained by copolymerizing a vinyl aromatic hydrocarbon, a (meth)acrylate and a sulfonic acid group-containing (meth)acrylamide and in which a copolymerization ratio of the sulfonic acid group-containing (meth)acrylamide in the copolymer is 0.8 to 4.0% by mass, is used as the charge control agent, and a weight average molecular weight of the charge control agent is 5,000 to 25,000, and wherein, in the suspension step, at least one of a monoester compound and a polyglycerol ester compound is used as the softening agent.

8. The method for producing the negatively-chargeable toner according to claim 7, wherein an amount of the softening agent is 1 to 25 parts by mass with respect to 100 parts by mass of the polymerizable monomer.

9. The method for producing the negatively-chargeable toner according to of claim 7, wherein an amount of the charge control agent is 0.1 to 8 parts by mass with respect to 100 parts by mass of the polymerizable monomer.

10. The method for producing the negatively-chargeable toner according to claim 7, wherein the negatively-chargeable toner has a core-shell structure.

* * * * *